US007318636B2

(12) United States Patent
Komatsu

(10) Patent No.: US 7,318,636 B2
(45) Date of Patent: Jan. 15, 2008

(54) METHOD FOR FORMING CORRECTION PATTERN, LIQUID EJECTING APPARATUS, AND CORRECTION PATTERN

(75) Inventor: Shinya Komatsu, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 218 days.

(21) Appl. No.: 10/834,374

(22) Filed: Apr. 29, 2004

(65) Prior Publication Data

US 2005/0001870 A1 Jan. 6, 2005

(30) Foreign Application Priority Data

May 1, 2003 (JP) ..... 2003-126799

(51) Int. Cl.
*B41J 29/393* (2006.01)
*B41J 29/38* (2006.01)

(52) U.S. Cl. ..... 347/19; 347/6; 347/12

(58) Field of Classification Search ..... 347/12
See application file for complete search history.

(56) References Cited

U.S. PATENT DOCUMENTS 6,328,419 B2 * 12/2001 Otsuki ..... 347/16
6,464,319 B1 * 10/2002 Teshigawara et al. ..... 347/19
6,554,387 B1 * 4/2003 Otsuki ..... 347/19

FOREIGN PATENT DOCUMENTS

JP 11-291470 A 10/1999

* cited by examiner

*Primary Examiner*—Matthew Luu
*Assistant Examiner*—Jannelle M. Lebron
(74) *Attorney, Agent, or Firm*—Sughrue Mion, PLLC

(57) ABSTRACT

A correction-pattern forming method, for example, for forming a correction pattern with which it is possible to precisely correct discrepancies between dot formation positions in the moving direction is achieved. A correction-pattern forming method for forming a correction pattern on a medium, comprises: a step of moving a nozzle row in which a plurality of nozzles for ejecting a liquid to form dots on a medium are arranged in a row; and a step of forming a correction pattern that has a difference in darkness in a moving direction of the nozzle row and that is for correcting a discrepancy between dot formation positions in the moving direction by causing at least two nozzles, among the plurality of nozzles, in the nozzle row to eject the liquid at a different timing for each nozzle.

11 Claims, 15 Drawing Sheets

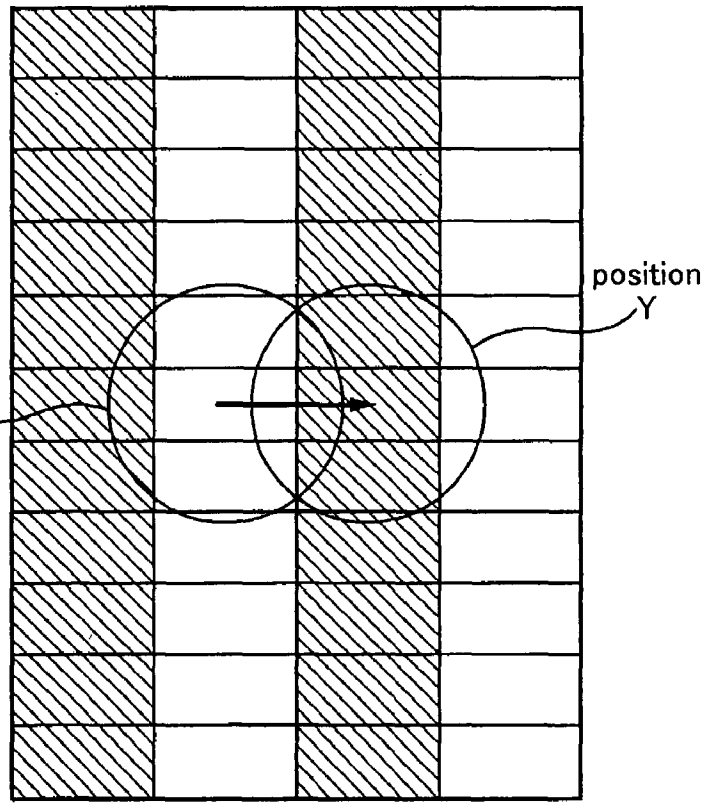
FIG. 14B
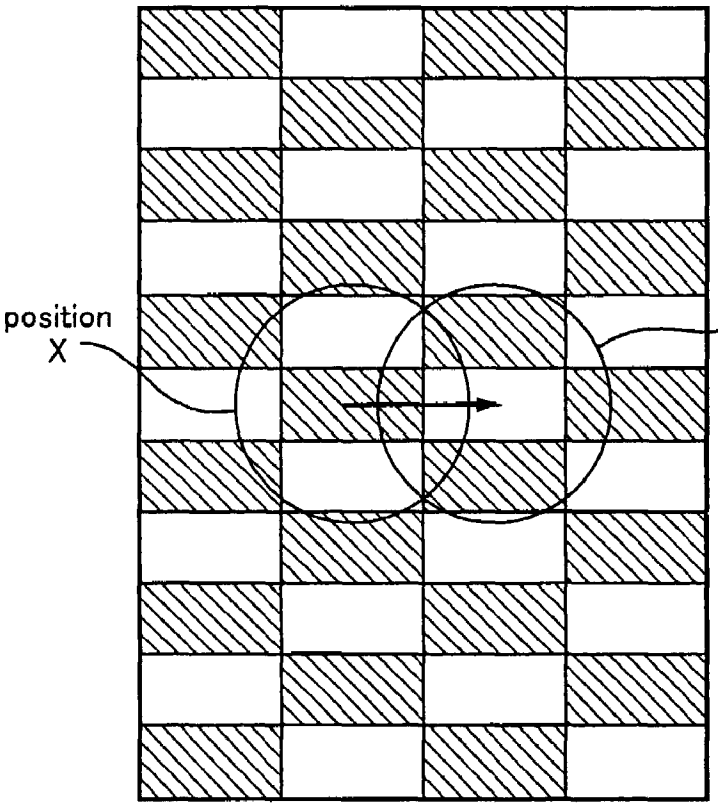
FIG. 14A
FIG. 14

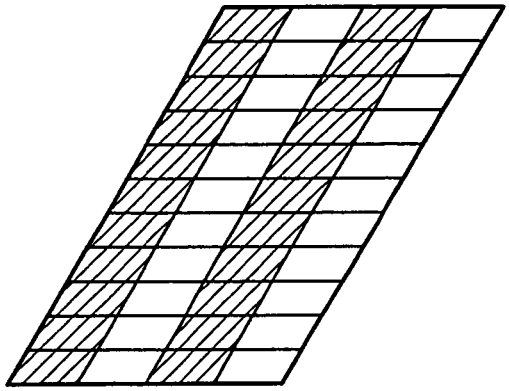
FIG. 17A
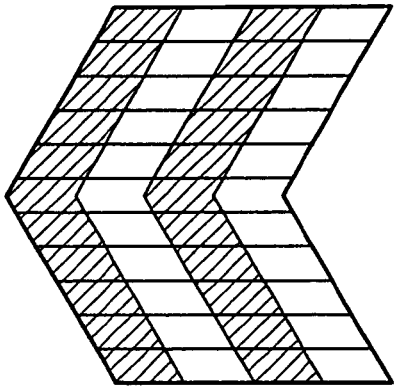
FIG. 17B
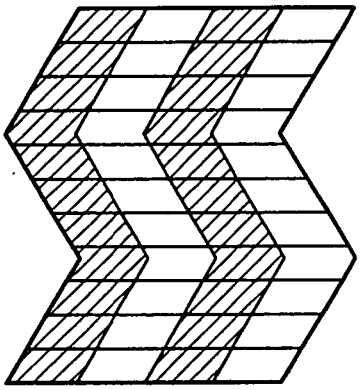
FIG. 17C
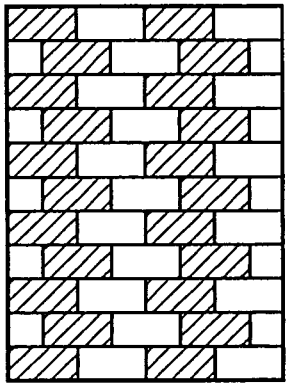
FIG. 17D
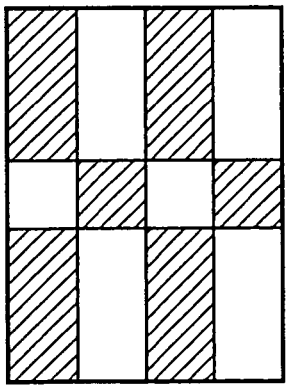
FIG. 17E
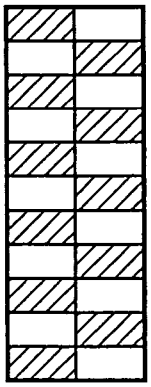
FIG. 17F
FIG. 17

METHOD FOR FORMING CORRECTION PATTERN, LIQUID EJECTING APPARATUS, AND CORRECTION PATTERN

CROSS-REFERENCE TO RELATED APPLICATIONS

The present application claims priority upon Japanese Patent Application No. 2003-126799 filed on May 1, 2003, which is herein incorporated by reference.

BACKGROUND OF THE INVENTION

1. Field of the Invention

The present invention relates to methods for forming correction patterns, liquid ejecting apparatuses, and correction patterns.

2. Description of the Related Art

Inkjet printers, which are a representative liquid ejecting apparatus, are well known. Inkjet printers are provided with an inkjet-type ejection head for ejecting ink, which is an example of a liquid, from nozzles, and are configured such as to record, for example, images or characters by ejecting ink onto print paper, which is an example of a medium. Among such inkjet printers, there are those that have a function of executing so-called "bidirectional printing," in which printing is implemented by ejecting ink in both forward and return passes in order to increase the printing speed.

When ejecting ink to form dots on a print paper in order to record, for example, images or characters with such inkjet printers, there are instances in which discrepancies occur between the dot formation positions, in the moving direction of the ejection head, of the dots that are formed in the forward pass, and the dot formation positions, in that moving direction, of the dots that are formed in the return pass in bidirectional printing. These discrepancies between dot formation positions are a cause of deteriorated quality in, for example, the recorded images and characters, and thus it is necessary that these discrepancies are corrected.

One method proposed for correcting such discrepancies between the dot formation positions is a method for forming a correction pattern, which has differences in darkness in the moving direction and which is used for correcting the above-mentioned discrepancies based on these differences in darkness, on print paper by ejecting ink from nozzles provided in an ejection head, and reading the darkness of the correction pattern using a sensor in order to obtain darkness information for correcting the discrepancies (see, for example, Patent Document 1).

SUMMARY OF THE INVENTION

When reading the darkness of the correction pattern using a sensor, there are instances where noise is generated in the waveform of the electric signal that the sensor outputs. This noise that is generated lowers the precision with which the darkness of the correction pattern is read, and as a result, it becomes difficult to precisely correct the discrepancies.

The present invention was arrived at in light of the foregoing issues, and it is an object thereof to achieve a method for forming a correction pattern and a liquid ejecting apparatus for forming a correction pattern with which it is possible to precisely correct discrepancies between dot formation positions in the moving direction, and a correction pattern with which it is possible to precisely correct discrepancies between the dot formation positions in the moving direction.

A primary aspect of the present invention is a method for forming a correction pattern such as the following.

A correction-pattern forming method for forming a correction pattern on a medium, comprises:

a step of moving a nozzle row in which a plurality of nozzles for ejecting a liquid to form dots on a medium are arranged in a row; and a step of forming a correction pattern that has a difference in darkness in a moving direction of the nozzle row and that is for correcting a discrepancy between dot formation positions in the moving direction by causing at least two nozzles, among the plurality of nozzles, in the nozzle row to eject the liquid at a different timing for each nozzle.

Other features of the present invention will become clear through the accompanying drawings and the following description.

BRIEF DESCRIPTION OF THE DRAWINGS

For a more complete understanding of the present invention and the advantages thereof, reference is now made to the following description taken in conjunction with the accompanying drawings.

FIG. 14A is a diagram showing how incident light emitted from a light-emitting section 29*a* of the reflective optical sensor 29 is incident on the present pattern.

FIG. 14B is a diagram showing how incident light emitted from the light-emitting section 29*a* of the reflective optical sensor 29 is incident on the conventional pattern.

FIG. 17A is a (first) diagram showing a variation of blocks making up forward pass patterns and return pass patterns of a correction pattern.

FIG. 17B is a (second) diagram showing a variation of blocks making up forward pass patterns and return pass patterns of a correction pattern.

FIG. 17C is a (third) diagram showing a variation of blocks making up forward pass patterns and return pass patterns of a correction pattern.

FIG. 17D is a (fourth) diagram showing a variation of blocks making up forward pass patterns and return pass patterns of a correction pattern.

FIG. 17E is a (fifth) diagram showing a variation of blocks making up forward pass patterns and return pass patterns of a correction pattern.

FIG. 17F is a (sixth) diagram showing a variation of blocks making up forward pass patterns and return pass patterns of a correction pattern.

DETAILED DESCRIPTION OF PREFERRED EMBODIMENTS

Figure 1:
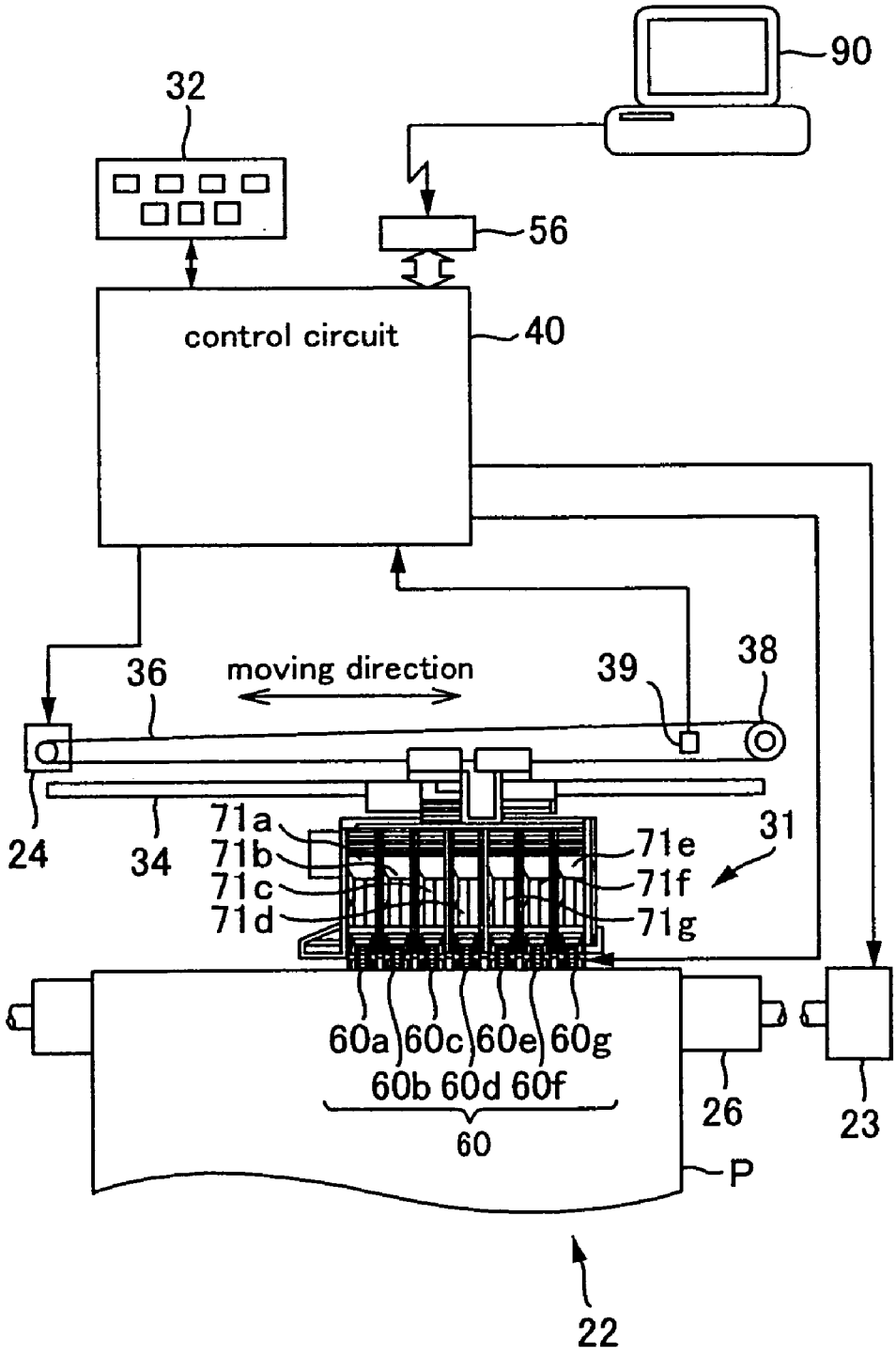
FIG. 1 is a diagram that schematically shows a configuration of a printing system provided with an inkjet printer 22.

At least the following matters will be made clear by the explanation in the present specification and the description of the accompanying drawings.

A correction-pattern forming method for forming a correction pattern on a medium, comprises:

a step of moving a nozzle row in which a plurality of nozzles for ejecting a liquid to form dots on a medium are arranged in a row; and a step of forming a correction pattern that has a difference in darkness in a moving direction of the nozzle row and that is for correcting a discrepancy between dot formation positions in the moving direction by causing at least two nozzles, among the plurality of nozzles, in the nozzle row to eject the liquid at a different timing for each nozzle.

With such a correction-pattern forming method, it is possible to form a correction pattern with which discrepancies between dot formation positions in the moving direction can be precisely corrected.

Further, a correction pattern that has a difference in darkness in the moving direction and that is for correcting a discrepancy between dot formation positions in the moving direction in a forward pass and dot formation positions in the moving direction in a return pass, may be formed on the medium by causing the nozzles to eject the liquid in the forward pass and the return pass while changing a difference between a timing at which the liquid is ejected from the nozzles in the forward pass and a timing at which the liquid is ejected from the nozzles in the return pass.

With such a correction-pattern forming method, it is possible to form a Bi-D adjustment pattern with which discrepancies between dot formation positions in the moving direction can be precisely corrected.

Further, the nozzle row may have a plurality of sub-nozzle rows arranged in the direction of the nozzle row; and the correction pattern may be formed by causing the nozzles to eject the liquid in such a manner that a timing at which the liquid is ejected from the nozzles that belong to even-numbered sub-nozzle rows, among the plurality of sub-nozzle rows, is different from a timing at which the liquid is ejected from the nozzles that belong to odd-numbered sub-nozzle rows, the timing at which the liquid is ejected from the nozzles that belong to the even-numbered sub-nozzle rows is the same among those sub-nozzle rows, and the timing at which the liquid is ejected from the nozzles that belong to the odd-numbered sub-nozzle rows is the same among those sub-nozzle rows.

With such a correction-pattern forming method, it is possible to form a correction pattern with which discrepancies between dot formation positions in the moving direction can be corrected more precisely.

Further, the correction pattern may be formed by repeating an operation of ejecting the liquid from the nozzles that belong to the even-numbered sub-nozzle rows and an operation of ejecting the liquid from the nozzles that belong to the odd-numbered sub-nozzle rows.

With such a correction-pattern forming method, it is possible to form a correction pattern with which discrepancies between dot formation positions in the moving direction can be corrected more precisely.

Further, a same number of nozzles may belong to each of the plurality of sub-nozzle rows.

With such a correction-pattern forming method, it is possible to form a correction pattern with which discrepancies between dot formation positions in the moving direction can be corrected more precisely.

Further, the darkness of the correction pattern may be read with a sensor that is capable of moving in the moving direction and that is for reading the darkness, while moving the sensor in the moving direction, and based on darkness information that has been read, the discrepancy may be corrected.

With such a correction-pattern forming method, the procedure for forming a correction pattern, with which discrepancies between dot formation positions in the moving direction can be corrected, becomes simple.

Further, another correction pattern different from the correction pattern, which has the difference in darkness in the moving direction and which is for correcting the discrepancy between the dot formation positions in the moving direction in the forward pass and the dot formation positions in the moving direction in the return pass, may be formed on the medium by causing the nozzles to eject the liquid in the forward pass and the return pass while changing, more finely than in the correction pattern, the difference between the timing at which the liquid is ejected from the nozzles in the forward pass and the timing at which the liquid is ejected from the nozzles in the return pass.

The foregoing correction pattern is formed by changing, more roughly than in the other correction patterns, the difference in the timing at which liquid is ejected from the nozzles in the forward pass and the timing at which liquid is ejected from the nozzles in the return path; therefore, vibration is more prone to occur. Consequently, when forming the foregoing correction pattern in which vibration occurs easily, it would be even more effective if liquid is ejected from at least two nozzles, among the plurality of nozzles, in the nozzle row at a different timing for each nozzle.

Further, the correction pattern may be formed by ejecting the liquid from the nozzles provided in one nozzle row selected from among a plurality of the nozzle rows; the darkness of the correction pattern may be read with the sensor while moving the sensor in the moving direction, and based on darkness information that has been read, a plurality of the other correction patterns are formed, each for one of the plurality of the nozzle rows; and the darkness of the plurality of the other correction patterns may be read with the sensor while moving the sensor in the moving direction, and based on darkness information that has been read, the discrepancy is corrected for each of the plurality of the nozzle rows.

With such a correction-pattern forming method, efficient discrepancy correction is possible.

Further, a liquid ejecting apparatus for ejecting a liquid onto a medium, comprises:

nozzles for ejecting a liquid to form dots on a medium;

a nozzle row in which a plurality of the nozzles are arranged in a row; and a controller for moving the nozzle row and causing the nozzles in the nozzle row to eject the liquid;

wherein the controller moves the nozzle row and causes at least two nozzles, among the plurality of the nozzles, in the nozzle row to eject the liquid at a different timing for each nozzle, to form a correction pattern that has a difference in darkness in a moving direction of the nozzle row and that is for correcting a discrepancy between dot formation positions in the moving direction.

With such a liquid ejecting apparatus, it is possible to form a correction pattern with which discrepancies between dot formation positions in the moving direction can be precisely corrected.

Further, the liquid ejecting apparatus may comprise a sensor that is capable of moving in the moving direction and that is for reading the darkness of the correction pattern.

With such a liquid ejecting apparatus, it is possible to use the sensor to form a correction pattern with which discrepancies between dot formation positions in the moving direction can be precisely corrected.

Further, a correction pattern formed on a medium, comprises:

a section formed by a liquid ejected at a predetermined timing from one nozzle among a plurality of nozzles arranged in a row; and a section formed by the liquid ejected at a timing that is different from the predetermined timing from another nozzle among the plurality of nozzles.

With such a correction pattern, discrepancies between dot formation positions in the moving direction can be precisely corrected.

Overview of Printer

Figure 2:
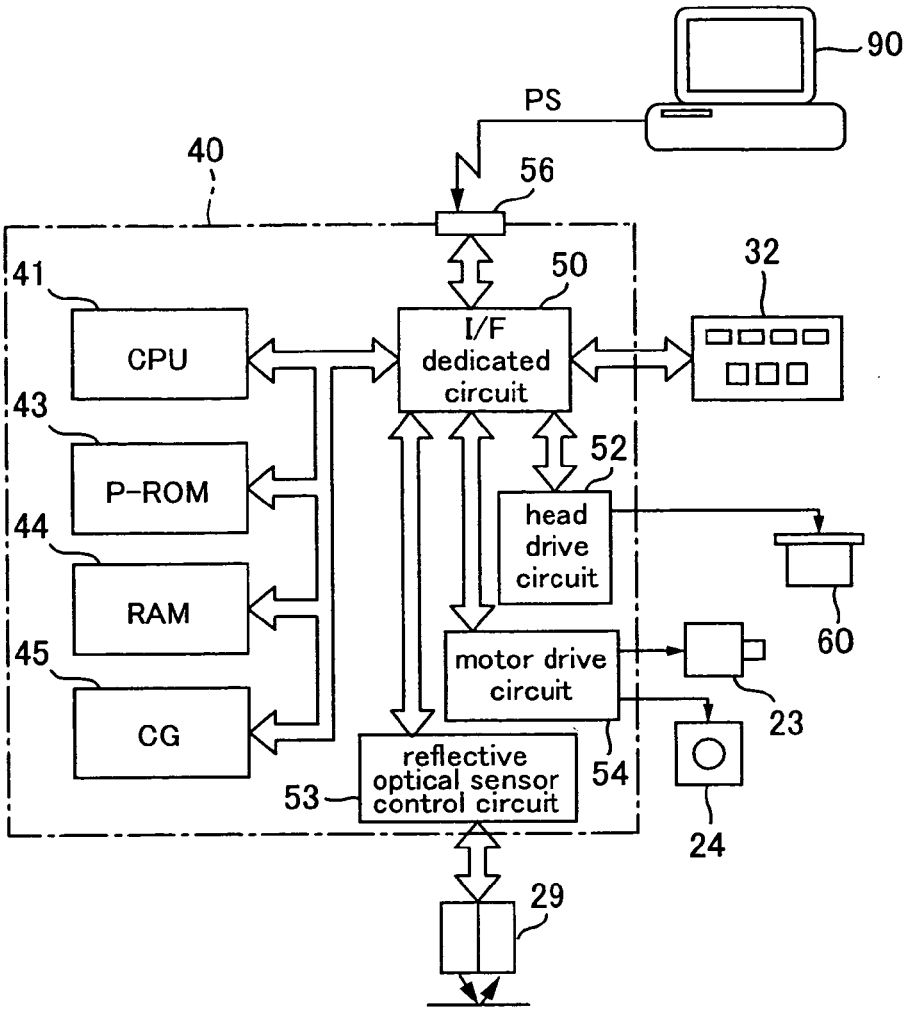
FIG. 2 is a block diagram showing a configuration of the printer 22, which serves as an example of a liquid ejecting apparatus, focusing on a control circuit 40.

First, an overview of a printer is described with reference to FIG. 1 and FIG. 2. FIG. 1 is a diagram schematically showing a configuration of a printing system provided with an inkjet printer 22 (hereinafter, also referred to as "printer"). FIG. 2 is a block diagram showing a configuration of the printer 22, which is an example of the liquid ejecting apparatus, focusing on a control circuit 40.

The printer 22 has a paper feed mechanism for feeding print paper p, which is an example of the medium, using a paper feed motor 23, and a carriage moving mechanism for moving a carriage 31 back and forth in the axial direction of a platen 26 using a carriage motor 24. Here, the direction in which the print paper P is fed by the paper feed mechanism is referred to simply as the paper feed direction, and the direction in which the carriage 31 is moved by the carriage moving mechanism is referred to simply as the moving direction. It should be noted that the carriage 31 is provided with a reflective optical sensor 29, which is an example of a sensor for reading the darkness of a later-described correction pattern.

The printer 22 is also provided with a head drive mechanism for driving an ejection head 60 mounted to the carriage 31 to control the ejection of ink, which is an example of liquid, and dot formation, and a control circuit 40, which is an example of a controller, for controlling the sending and receiving of signals to and from the paper feed motor 23, the carriage motor 24, the ejection head 60, the reflective optical sensor 29, and a control panel 32. The control circuit 40 is connected to a computer 90 via a connector 56. The computer 90 is provided with a driver for the printer 22, and functions as a user interface for receiving commands made by a user operating a keyboard or a mouse, for example, and for displaying various types of information in the printer 22 to the user through a screen display of a display device.

The paper feed mechanism for carrying the print paper P is provided with a gear train (not shown) that transmits the rotation of the paper feed motor 23 to the platen 26 and a paper carry roller (not shown). Further, the carriage moving mechanism for moving the carriage 31 back and forth is provided with a slide shaft 34, which is provided parallel to the axis of the platen 26 and which slidably retains the carriage 31, a pulley 38, wherein an endless drive belt 36 is provided spanning between the pulley 38 and the carriage motor 24, and a position detection sensor 39 for detecting the position of origin of the carriage 31.

As shown in FIG. 2, the control circuit 40 is constituted as an arithmetic and logic circuit that is provided with a CPU 41, a programmable ROM (P-ROM) 43, a RAM 44, and a character generator (CG) 45 storing character dot matrix. The control circuit 40 is further provided with an I/F dedicated circuit 50 whose purpose is to function as an interface with respect to external motors etc., a head drive circuit 52 connected to the I/F dedicated circuit 50 for driving the ejection head 60 and causing it to eject ink, a motor drive circuit 54 for driving the paper feed motor 23 and the carriage motor 24, and a control circuit 53 for controlling the reflective optical sensor. The I/F dedicated circuit 50 is internally provided with a parallel interface circuit, and via the connector 56, it is capable of receiving print signals PS supplied from the computer 90.

It should be noted that the paper supplying operation for supplying print paper P to the printer 22 and the paper discharge operation for discharging print paper P from the color inkjet printer 22 are performed using the paper feed roller 23.

Example Configuration of Reflective Optical Sensor

Figure 3:
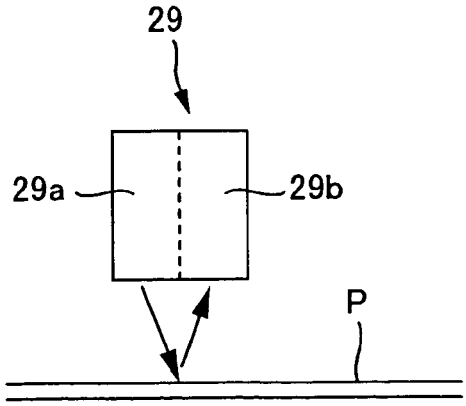
FIG. 3 is a schematic representation for describing an example of a reflective optical sensor 29.

An example of a configuration of the reflective optical sensor is described next with reference to FIG. 3. FIG. 3 is a schematic diagram for describing an example of the reflective optical sensor 29.

The reflective optical sensor 29 is attached to the carriage 31, and has a light-emitting section 29*a*, which is, for example, made of a light emitting diode, and a light-receiving section 29*b*, which is, for example, made of a phototransistor. The light that is emitted from the light-emitting section 29*a*, that is, the incident light, is reflected by print paper P and that reflected light is received by the light-receiving section 29*b* and converted into an electric signal. Then, the intensity of the electric signal is measured as the output value of the light-receiving sensor corresponding to the intensity of the reflected light that is received. Therefore, the reflective optical sensor 29 has the function of reading the darkness of the pattern on the print paper P.

It should be noted that in the above description, as shown in the figure, the light-emitting section 29*a* and the light-receiving section 29*b* together structure a device called the reflective optical sensor 29, but they may also constitute separate devices, such as a light-emitting device and a light-receiving device.

Further, in the above description, the reflected light is converted into an electric signal and then the intensity of that electric signal is measured in order to obtain the intensity of the reflected light that is received. However, this is not a limitation, and it is only necessary that the output value of the light-receiving sensor, which corresponds to the intensity of the reflected light received, can be measured.

Configuration of Ejection Head

Figure 4:
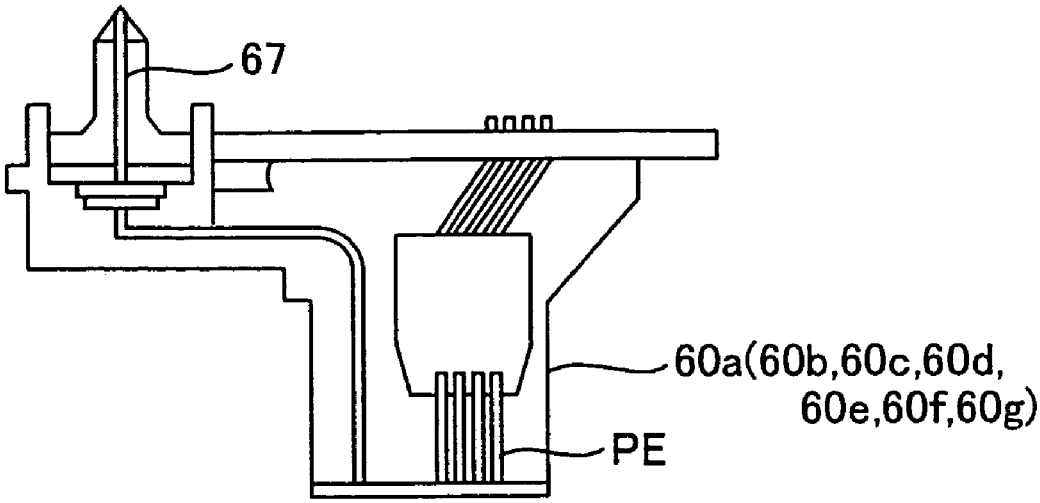
FIG. 4 is an explanatory diagram showing a schematic configuration of the interior of an ejection head 60.
Figure 4:
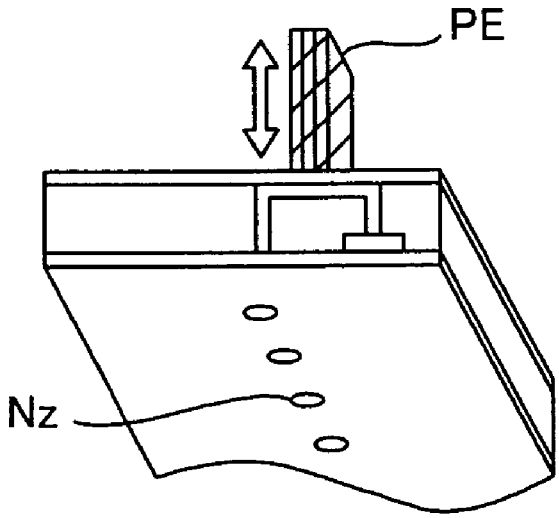
Figure 5:
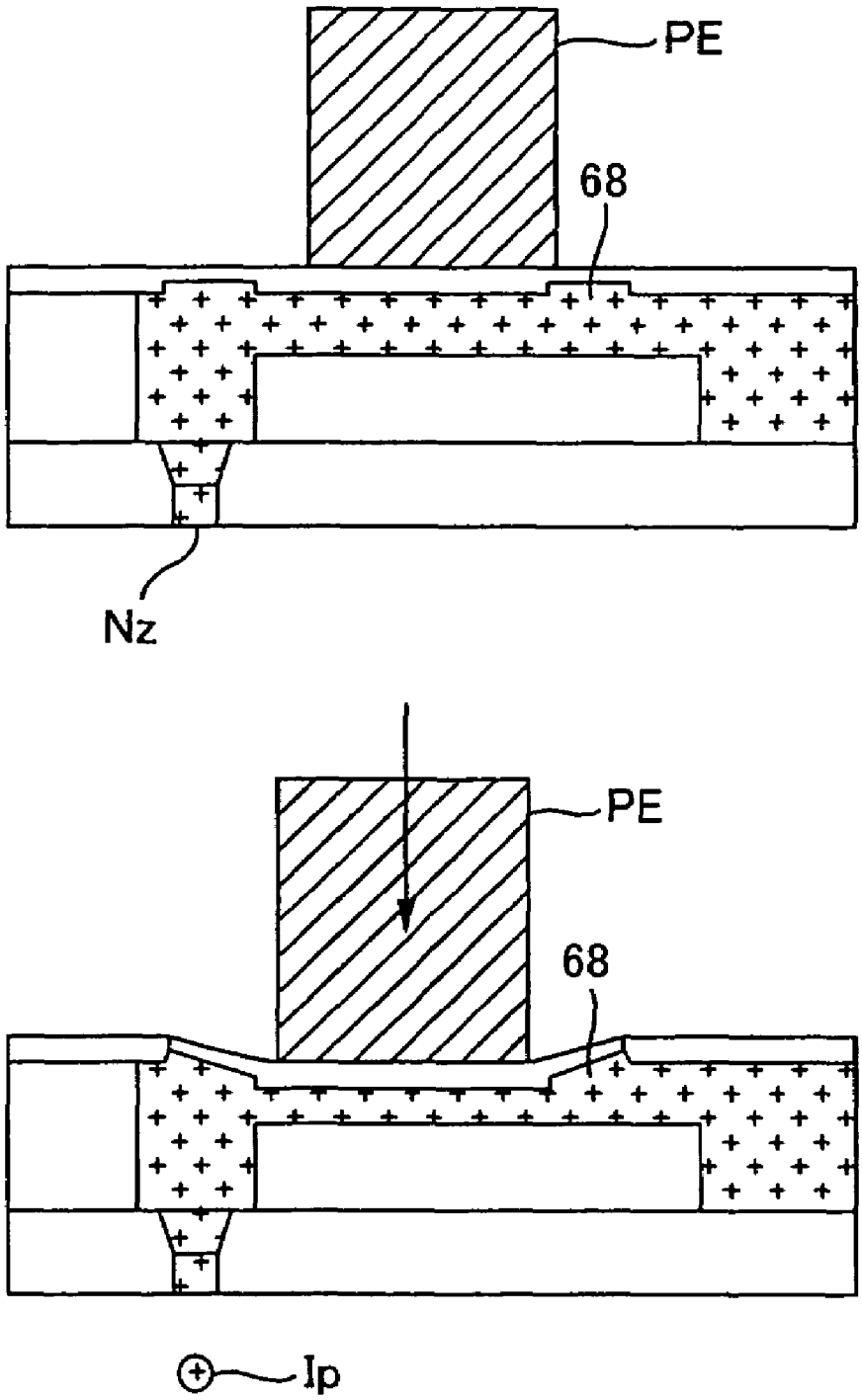
FIG. 5 is an explanatory diagram showing in detail a structure of a piezoelectric element PE and a nozzle Nz.
Figure 6:
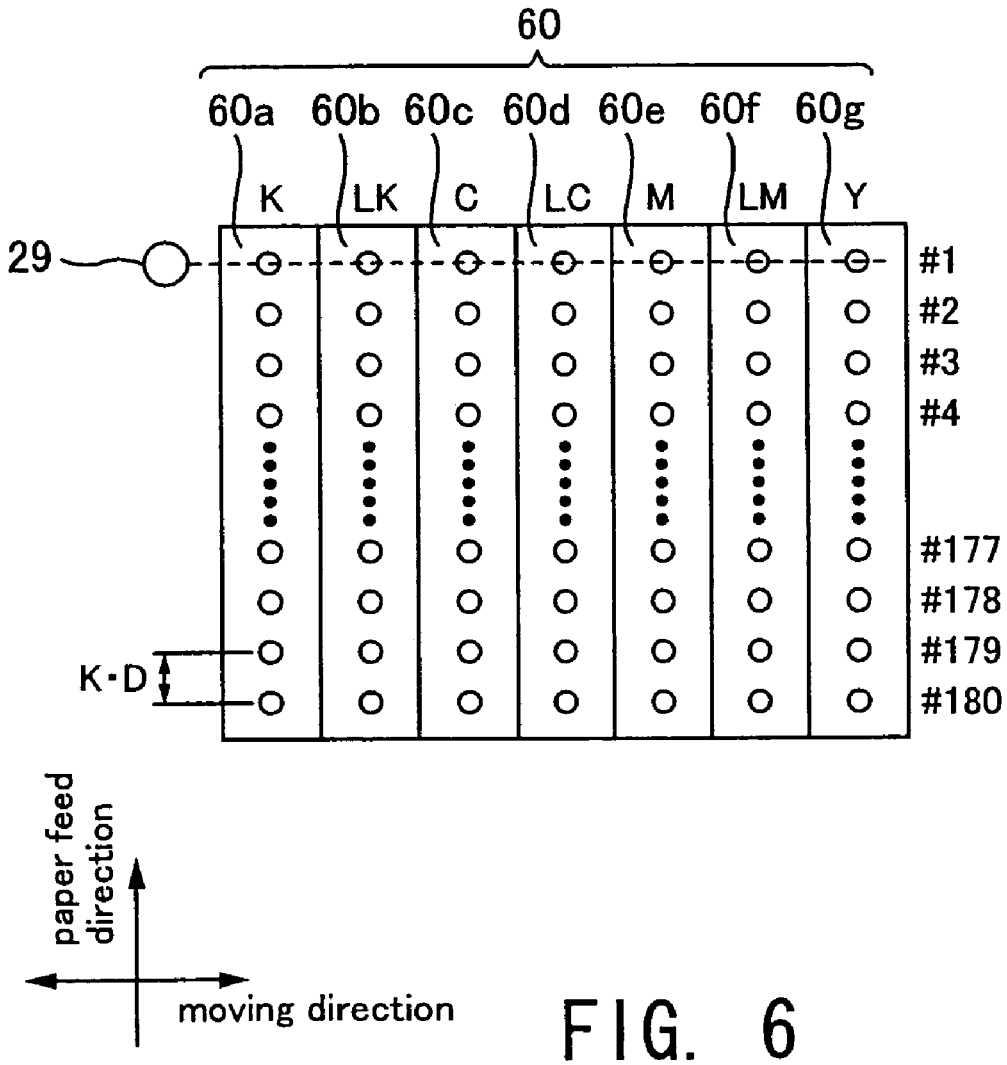
FIG. 6 is an explanatory diagram showing how the nozzles Nz are arranged in the ejection head 60.

A configuration of the ejection head is described next with reference to FIG. 4, FIG. 5, and FIG. 6. FIG. 4 is an explanatory diagram schematically showing a configuration inside the ejection head 60. FIG. 5 is an explanatory diagram showing in detail a structure of a piezoelectric element PE and a nozzle Nz. FIG. 6 is an explanatory diagram showing an arrangement of the nozzles Nz in the ejection head 60.

It is possible to mount, to the carriage 31 (FIG. 1), a cartridge 71*a* for black (K) ink, a cartridge 71*b* for light black (LK) ink, a cartridge 71*c* for cyan (C) ink, a cartridge 71*d* for light cyan (LC) ink, a cartridge 71*e* for magenta (M) ink, a cartridge 71*f* for light magenta (LM) ink, and a cartridge 71*g* for yellow (Y) ink.

The ejection head 60 is provided at a lower section of the carriage 31, and the ejection head 60 is made of a total of seven separate-color ejection heads 60*a*, 60*b*, 60*c*, 60*d*, 60*e*, 60*f*, and 60*g*. A guide duct 67 (see FIG. 4) for guiding ink from ink tanks to these separate-color ejection heads 60*a*, 60*b*, 60*c*, 60*d*, 60*e*, 60*f*, and 60*g* is provided at a bottom section of the carriage 31. When cartridges 71*a*, 71*b*, 71*c*, 71*d*, 71*e*, 71*f*, and 71*g* are mounted to the carriage 31 from above, the guide duct 67 is inserted into a connection aperture provided in each cartridge, allowing ink to be supplied from each cartridge to the respective separate-color ejection heads 60*a*, 60*b*, 60*c*, 60*d*, 60*e*, 60*f*, and 60*g*.

When the cartridges 71*a*, 71*b*, 71*c*, 71*d*, 71*e*, 71*f*, and 71*g* are mounted to the carriage 31, the ink within the cartridges is drawn out via the guide duct 67 and guided to the separate-color ejection heads 60*a*, 60*b*, 60*c*, 60*d*, 60*e*, 60*f*, and 60*g* provided in the lower section of the carriage 31 as shown in FIG. 4.

Piezoelectric elements PE, which are electrostrictive elements with excellent responsiveness, are arranged for each nozzle Nz in the separate-color ejection heads 60*a*, 60*b*, 60*c*, 60*d*, 60*e*, 60*f*, and 60*g* provided in the lower section of the carriage 31. Further, as shown in the upper half of FIG. 5, the piezoelectric elements PE are arranged at positions in contact with an ink channel 68 that guides the ink to the nozzles Nz. As is well known, the piezoelectric elements PE are elements whose crystalline structure is distorted by the application of a voltage and very quickly convert this electrical energy into mechanical energy. In the present working example, when a voltage of a predetermined duration is applied between electrodes provided on both ends of each piezoelectric element PE, then, as shown in the lower half of FIG. 5, the piezoelectric elements PE expand for the duration of voltage application and deform a lateral wall of the ink channel 68. As a result, the volume of the ink channel 68 is constricted in accordance with the expansion of the piezoelectric elements PE, and an amount of ink that corresponds to this constriction is quickly ejected from the tip of the nozzle Nz as ink droplets Ip. The ink droplets Ip soak into the print paper P mounted on the platen 26 and form dots, and in this manner printing is carried out.

As shown in FIG. 6, the ejection head 60 has a black nozzle row, a light black nozzle row, a cyan nozzle row, a light cyan nozzle row, a magenta nozzle row, a light magenta nozzle row, and a yellow nozzle row, each arranged in a straight line in the paper feed direction. Each nozzle row is provided with 180 nozzles #1 to #180, and the nozzles #1 to #180 are arranged at a constant nozzle pitch k·D in the paper feed direction. Here, D is the dot pitch in the paper feed direction, and k is an integer. Hereinafter, the integer k expressing the nozzle pitch k·D is referred to simply as the "nozzle pitch k." In the example of FIG. 8, the nozzle pitch k is four dots. The nozzle pitch k, however, can be set to any integer.

It should be noted that the length of the ejection head 60 in the paper feed direction is approximately one inch.

Further, the above-described reflective optical sensor 29 is attached the carriage 31 together with the ejection head 60, and in the present embodiment, as shown in the figures, the position of the reflective optical sensor 29 in the paper feed direction matches the position of the nozzle #1 in the paper feed direction.

The direction in which the carriage 31 is moved by the carriage moving mechanism intersects with the direction of the nozzle rows.

The printer 22 having the above hardware configuration carries the print paper P using the paper feed motor 23 while moving the carriage 31 back and forth with the carriage motor 24 and simultaneously driving the piezoelectric elements PE of the ejection head 60 to eject inks of different colors and form dots, thereby forming multicolor images on the print paper P.

It should be noted that here, a printer 22 provided with a head that ejects ink using piezoelectric elements PE is employed as discussed above, but it is also possible to employ various types of ejection drive elements other than piezoelectric elements. For example, the present invention is also applicable to printers provided with ejection drive elements of a type that eject ink using bubbles generated within the ink channel by passing a current through a heater arranged in the ink channel. Further, any configuration may be adopted for the control circuit 40, as long as the configuration allows the control circuit 40 to supply drive signals to the ejection drive elements and generate drive signals such that the temporal ejection order of the ink droplets in the forward and return passes is kept the same.

Driving the Ejection Head

Figure 7:
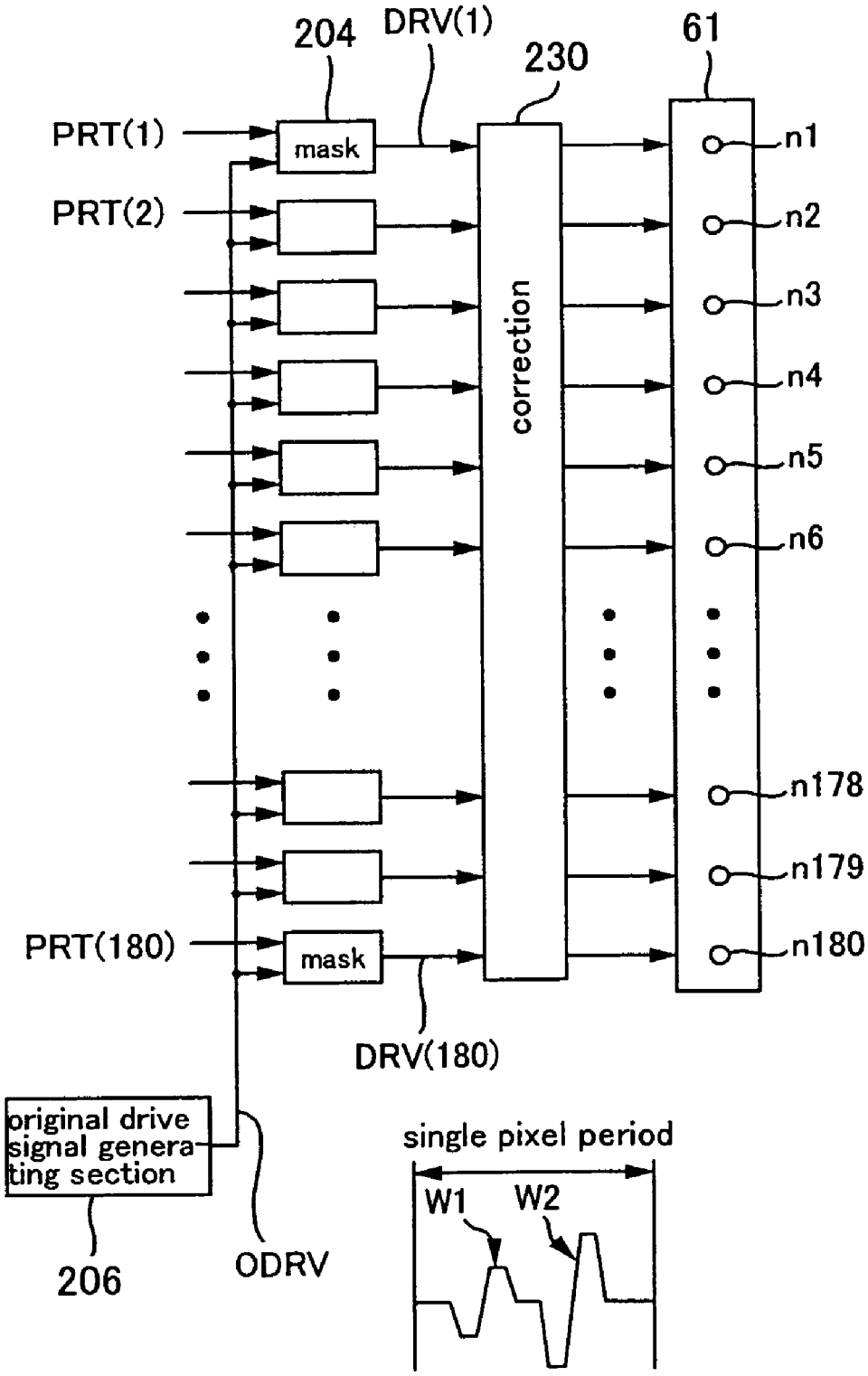
FIG. 7 is a block diagram showing a configuration of a drive signal generating section provided in a head drive circuit 52.

The driving of the ejection head 60 is described next with reference to FIG. 7. FIG. 7 is a block diagram showing a configuration of a drive signal generating section provided in the head drive circuit 52 (FIG. 2).

In FIG. 7, a drive signal generating section is provided with a plurality of mask circuits 204, an original drive signal generating section 206, and a drive signal correcting section 230. The mask circuits 204 are provided corresponding to the plurality of piezoelectric elements PE for driving the nozzles n1 to n180 of the ejection head 61*a*. It should be noted that in FIG. 7, the number within parentheses appended to the end of each signal name indicates the number of the nozzle to which that signal is supplied. The original drive signal generating section 206 generates an original drive signal ODRV that is common to the nozzles n1 to n180. The original drive signal ODRV is a signal that includes two pulses, namely a first pulse W1 and a second pulse W2, within a single pixel period. The drive signal correcting section 230 performs correction by shifting, either forward or backward, the timing of the drive signal waveforms shaped by the mask circuits 204. By correcting the timing of the drive signal waveforms, discrepancies between the positions where dots are formed in the moving direction are corrected.

It should be noted that in this embodiment, the drive generation signal section provided in the head drive circuit 52 (FIG. 2) shown in FIG. 7 is provided for each nozzle row.

Correction Pattern for Correcting Discrepancies between Dot Formation Positions in the Moving Direction The printer 22 described above ejects ink from the nozzles to form, on the print paper P, a correction pattern that has differences in darkness in the moving direction and that is for correcting, based on these differences in darkness, discrepancies between the dot formation positions in the moving direction in the forward pass and the dot formation positions in the moving direction in the return pass.

Figure 8:
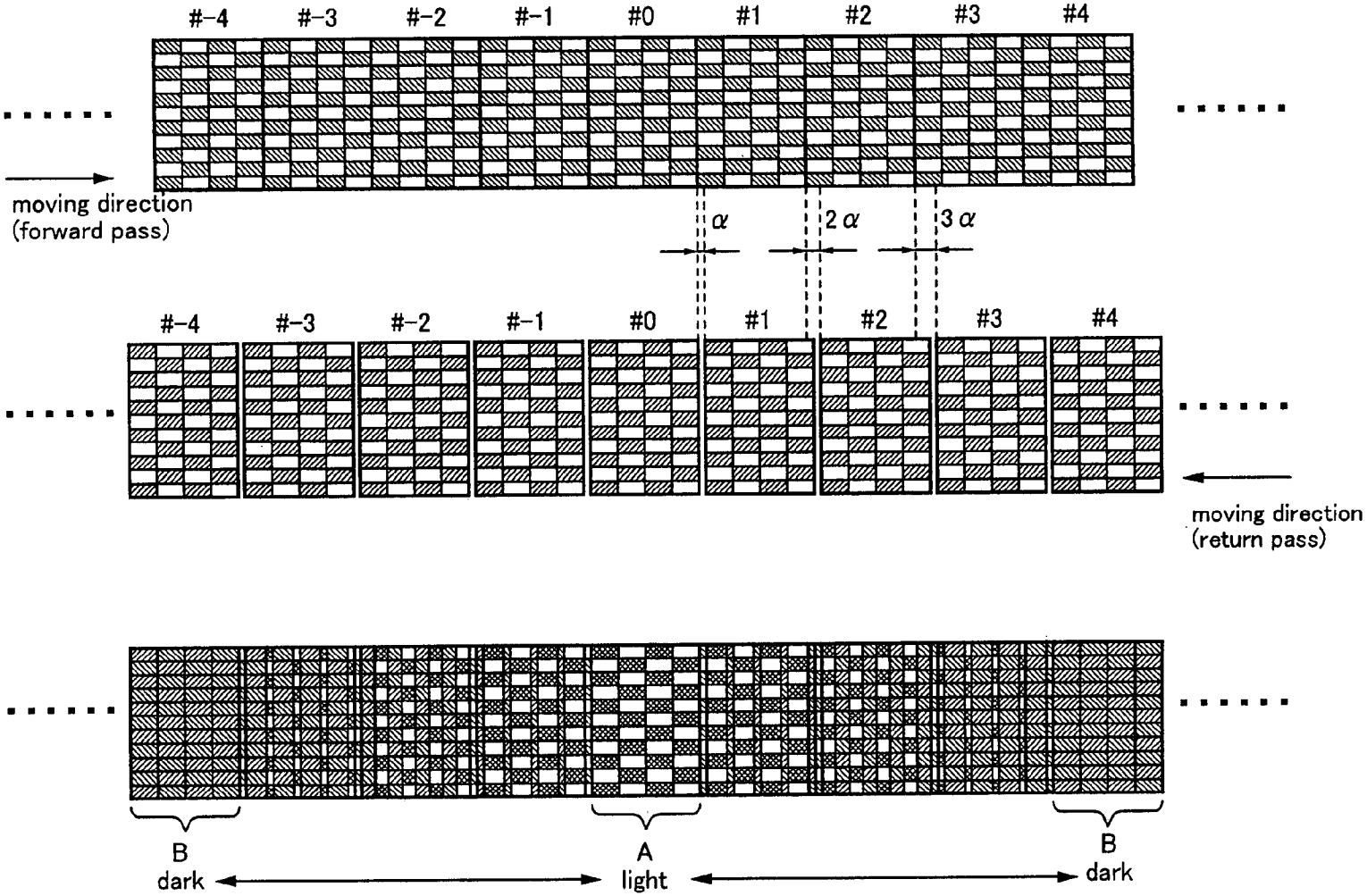
FIG. 8 is a diagram showing a correction pattern according to an embodiment.
Figure 9:
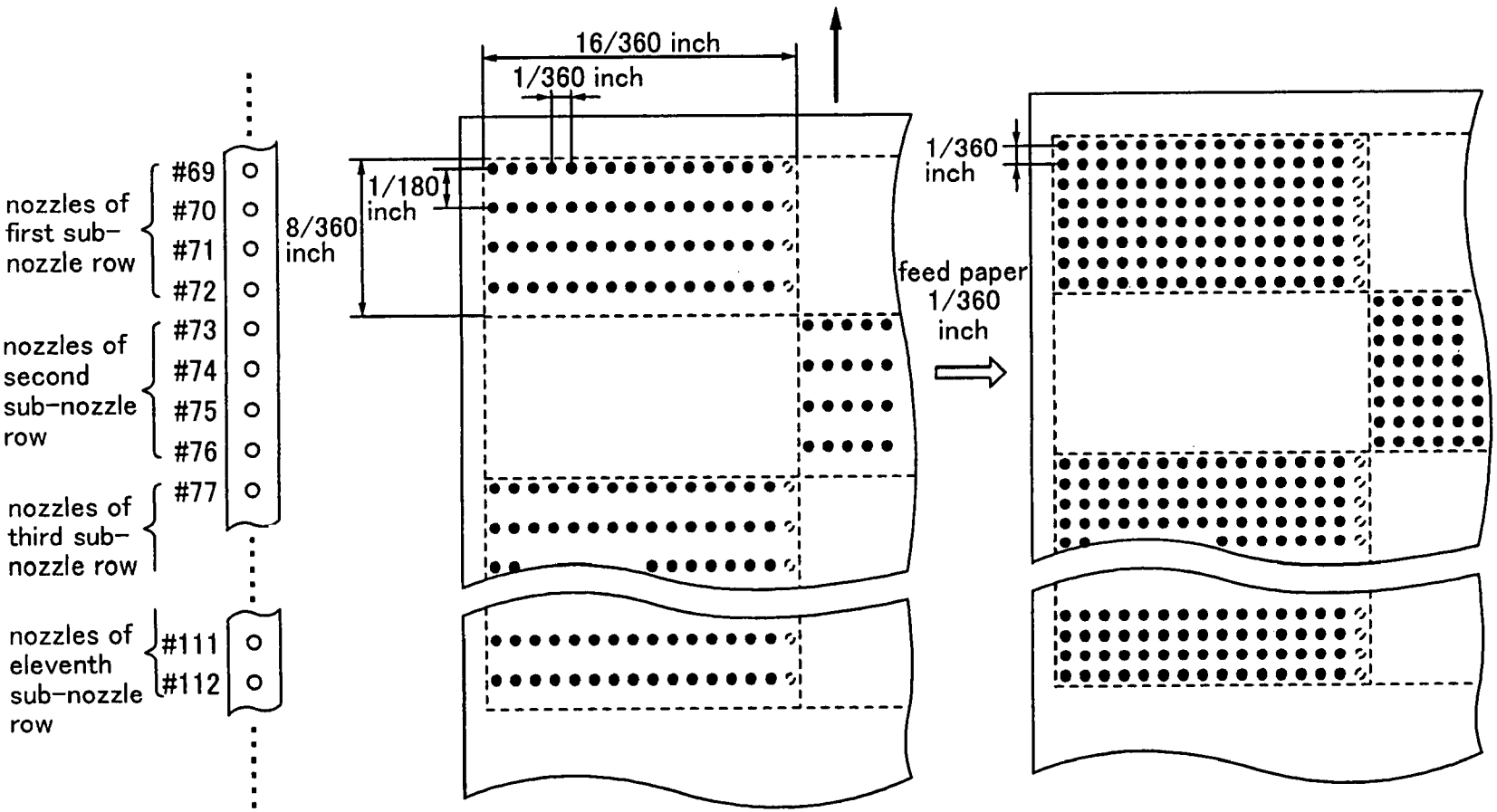
FIG. 9 is a diagram for describing a procedure for forming the correction pattern.
Figure 10:
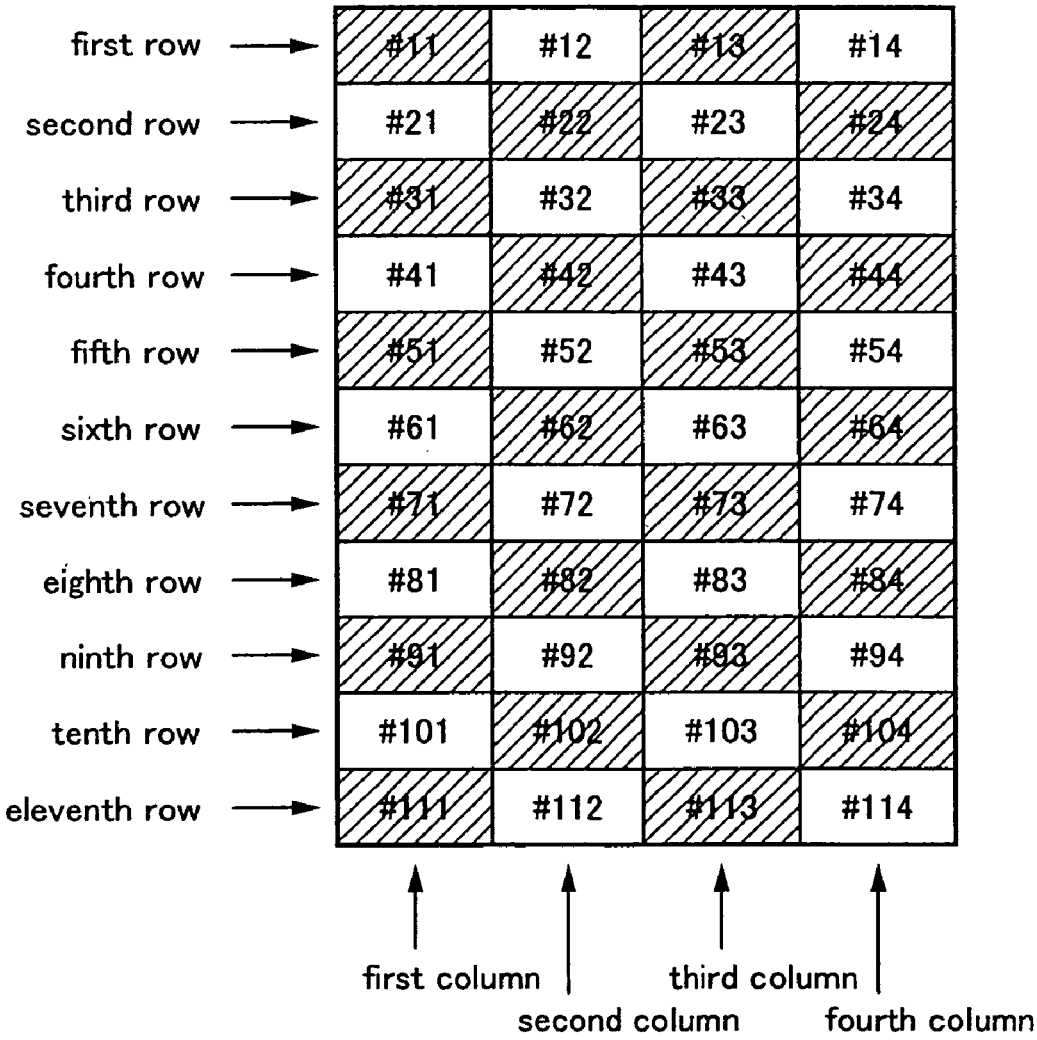
FIG. 10 is a diagram showing the numbers of the cells making up a block.
Figure 11:
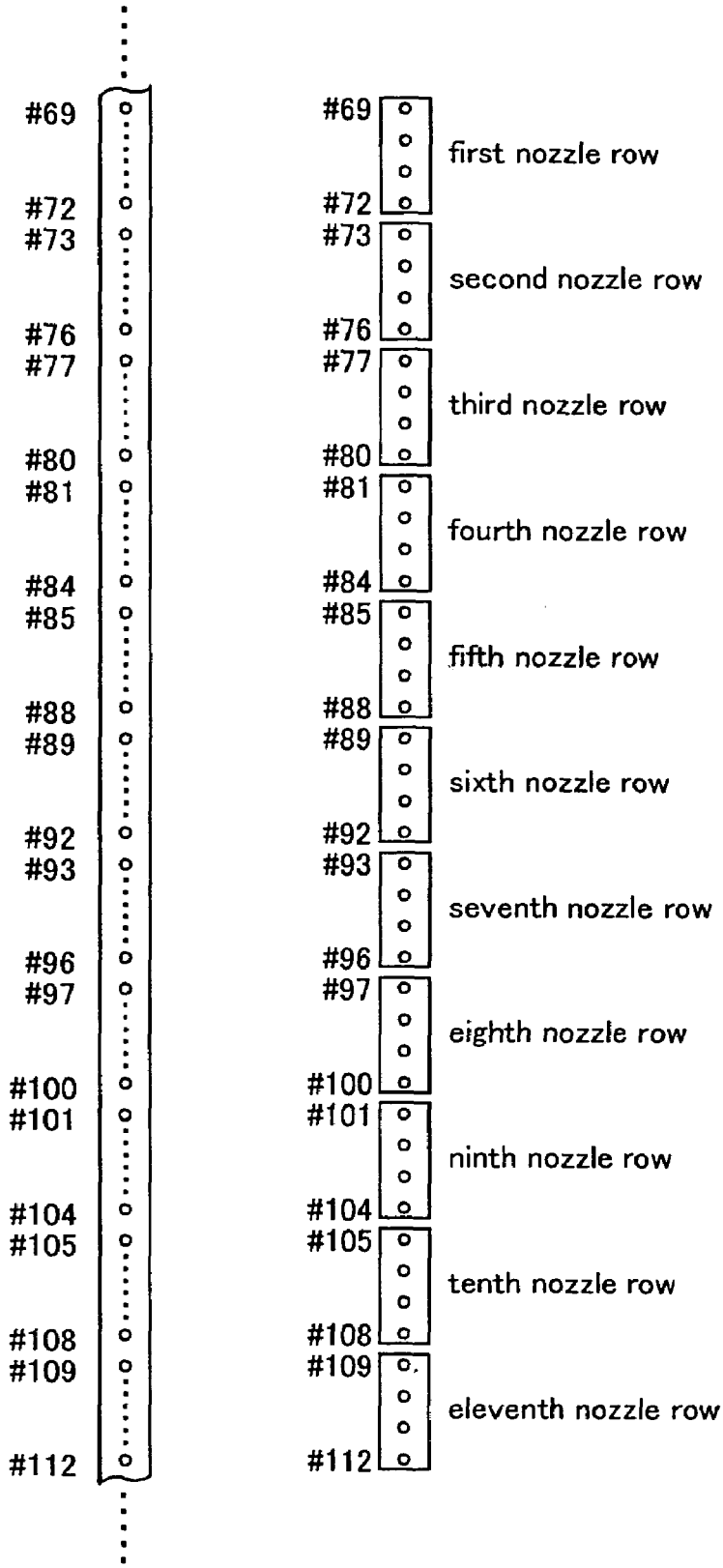
FIG. 11 is a diagram showing sub-nozzle rows.

Here, this correction pattern is described using FIG. 8 to FIG. 16. FIG. 8 is a diagram illustrating a correction pattern according to the present embodiment. FIG. 9 is a diagram for describing a procedure for forming the correction pattern. FIG. 10 is a diagram showing the numbers of cells making up the blocks. FIG. 11 is a diagram illustrating sub-nozzle rows. FIG. 12A to FIG. 16 are described later.

Method for Forming Correction Pattern

First, the method for forming the correction pattern is described using FIG. 8. The printer 22, in the forward and return passes, ejects ink from the nozzles to form the correction pattern. That is, the printer 22 moves the ejection head 60 in the moving direction and forms the forward pass pattern shown in the upper part of FIG. 8, then moves the ejection head 60 in a moving direction that is opposite to the previous direction and forms the return pass pattern shown in the middle of FIG. 8. For the sake of simplicity, FIG. 8 shows the forward pass pattern and the return pass pattern at different positions in the figure, but in practice, both patterns are formed overlapping one another. As a result of the two patterns being overlapped on one another, a correction pattern shown in the lower part of FIG. 8 is completed. It should be noted that in this embodiment, the left-to-right direction in the diagram is defined as the forward pass of the moving direction, and the right-to-left direction of the diagram is defined as the return pass of the moving direction.

The forward pass pattern of the upper part of FIG. 8 is considered below. As shown in the figure, the forward pass pattern is formed such that rectangular regions in which ink has been ejected and dots have been formed (regions indicated by hatch lines in the figure) and rectangular regions in which ink has not been ejected and dots have not been formed are arranged side by side in alternation. To facilitate understanding of the following description, the rectangular regions in which dots have been formed are referred to as black cells, the rectangular regions in which dots have not been formed are referred to as white cells, and both these may also be referred to simply as cells. Further, a region made of a total of 44 cells—four cells in the moving direction and eleven cells in the paper feed direction—is referred to as a block. Nine blocks are shown in the upper part of FIG. 8. That is, the forward pass pattern is an aggregation of a plurality of cells, and as shown in the figure, has a checkered pattern.

The return pass pattern in the middle of FIG. 8 is considered next. The return pass pattern, like the forward pass pattern, is formed such that rectangular regions in which ink has been ejected and dots have been formed and rectangular regions in which ink has not been ejected and dots have not been formed are arranged side by side in alternation, and as a result has a checkered pattern. However, unlike the forward pass pattern, it has gaps between the above-described blocks as shown in the figure (the size of these gaps is defined as $\alpha$). That is, in comparing the relative positions of the blocks of the forward pass pattern and the blocks of the return pass pattern, for the block shown by the sign #0 (hereafter, referred to simply as "block #0") there is no difference in the relative position between the forward pass and the return pass, but for block #1 there is a deviation of $\alpha$, for block #2 there is a deviation of $2\alpha$, and for block #3 there is a deviation of $3\alpha$. This is caused by forming the forward pass pattern and the return pass pattern while changing the difference between the timing at which ink is ejected from the nozzles in the forward pass and the timing at which ink is ejected from the nozzles in the return pass. It should be noted that in FIG. 8, when forming the forward pass pattern and the return pass pattern, the block for which the relative positions match is defined as block #0, and the blocks formed to the right of this block in the figure are defined, in order, as blocks #1, #2, #3, . . . , and the blocks formed to the left of this block in the figure are defined, in order, as blocks #-1, #- 2, #-3, . . . .

The completed correction pattern at the lower part of FIG. 8 is considered next. As can be understood from the figure, this correction pattern has differences in darkness in the moving direction. That is, at the position shown by the letter A in the figure, the correction pattern is formed by the block #0 of the forward pass pattern and the block #0 of the return pass pattern match one another, and thus the positions of the black cells of both patterns match one another and result in a checkered pattern; whereas with increasing distance to the left or right away from the position shown by the letter A in the figure, the position discrepancies between the black cells of the patterns grow larger and the proportion of the regions in which dots have been formed increases. Then, at the positions shown by the letter B in the figure, the white cells of block #4 (or #-4) of the return pass pattern are buried under the black cells of the forward pass pattern, and the proportion of regions in which dots have been formed becomes the largest. Consequently, the darkness of the correction pattern is lightest at the position shown by the letter A in the figure, and is darkest at the positions shown by the letter B in the figure.

It should be noted that in FIG. 8, to facilitate understanding of the figure, the correction pattern is shown with the size of the gap $\alpha$ defined as ¼ the width of the cells in the moving direction, but in the present embodiment, the correction pattern is formed with the size of the gap $\alpha$ defined as 1/32 that width. In this case, the darkness is lightest at the position on the correction pattern where the correction pattern is formed by the block #0 of the forward pass pattern and the block #0 of the return pass pattern, and the darkness is darkest at the position on the correction pattern where the white cells of the block #32 (or #-32) of the return pass pattern are buried by the black cells of the forward pass pattern.

The basic procedure of forming the correction pattern is described using FIG. 9 and FIG. 10. To simplify and facilitate understanding of the description, the procedure for forming a single block is described here. Also, for the sake of simplifying the description, numbers such as those shown in FIG. 10 are attached to the 44 cells of the eleven rows and four columns making up a block.

As shown in the left part of FIG. 9, in the present embodiment, the correction pattern is formed by ejecting ink from some of the nozzles of the nozzle row, which has 180 nozzles, that is, from the nozzles #69 to #112.

A description of these nozzles is provided here. As shown in FIG. 11, a portion of the nozzle row, which has 180 nozzles, is divided into a plurality of sub-nozzle rows lined up in the direction of that nozzle row. The sub-nozzle rows thus obtained by division are: a first sub-nozzle row made of the nozzles #69 to #72; a second sub-nozzle row made of the nozzles #73 to #76; a third sub-nozzle row made of the nozzles #77 to #80; a fourth sub-nozzle row made of the nozzles #81 to #84; a fifth sub-nozzle row made of the nozzles #85 to #88; a sixth sub-nozzle row made of the nozzles #89 to #92; a seventh sub-nozzle row made of the nozzles #93 to #96; an eighth sub-nozzle row made of the nozzles #97 to #100; a ninth sub-nozzle row made of the nozzles #101 to #104; a tenth sub-nozzle row made of the nozzles #105 to #108; and an eleventh sub-nozzle row made of the nozzles #109 to #112. Four nozzles belong to each sub-nozzle row, and this number is the same among the sub-nozzle rows. Further, each sub-nozzle row obtained by division is responsible for respectively forming the eleven cells lined up in the paper feed direction mentioned above.

First, ink is ejected from these nozzles to form a first column of cells. As shown in FIG. 10, the black cells in the first column of cells are cells #11, #31, #51, #71, #91, and #111, and therefore, by ejecting ink from the nozzles making up the first, third, fifth, seventh, ninth, and eleventh sub-nozzle rows among the sub-nozzle rows mentioned above, the first column of cells is formed.

The second column of cells is formed next. Since the black cells in the second column of cells are cells #22, #42, #62, #82, and #102, by ejecting ink from the nozzles making up the second, fourth, sixth, eighth, and tenth sub-nozzle rows among the sub-nozzle rows mentioned above, the second column of cells is formed.

In other words, in the moving direction, ink is not ejected from the 44 nozzles at the same timing, but instead, at least two nozzles of the 44 nozzles eject ink at a different timing for each nozzle. That is to say, the correction pattern comprises a section that is formed by ink ejected at a predetermined timing from one nozzle of the plurality of nozzles arranged in a row and a section that is formed by ink ejected at a timing that is different from the predetermined timing from another nozzle of the plurality of nozzles.

More specifically, ink is ejected from the nozzles in the moving direction such that: the timing at which ink is ejected from the nozzles belonging to the even-numbered sub-nozzle rows (second, fourth, sixth, eighth, and tenth sub-nozzle rows) of the sub-nozzle rows is different from the timing at which ink is ejected from the nozzles belonging to the odd-numbered sub-nozzle rows (first, third, fifth, seventh, ninth, and eleventh sub-nozzle rows); and the timing at which ink is ejected from the nozzles belonging to the even-numbered sub-nozzle rows is the same for those nozzles, and the timing at which ink is ejected from the nozzles belonging to the odd-numbered sub-nozzle rows is the same for those nozzles.

The third and fourth cell columns are formed next. When forming the third column of cells, in the same way as when forming the first column of cells, ink is ejected from the nozzles of the first, third, fifth, seventh, ninth, and eleventh sub-nozzle rows, and when forming the fourth column of cells, as when forming the second column of cells, ink is ejected from the nozzles of the second, fourth, sixth, eighth, and tenth sub-nozzle rows. That is, the correction pattern is formed by repeating the operation of ejecting ink from nozzles belonging to the even-numbered sub-nozzle rows and the operation of ejecting ink from the nozzles belonging to the odd-numbered sub-nozzle rows.

The dot resolution of the dots that are formed in the black cells is considered next with reference to cell #11 shown in FIG. 9.

As shown in FIG. 9, dots are formed in the moving direction at a spacing of $1/360$ inch, and thus the dot resolution is 360 dpi. Fifteen dots are formed in the moving direction within a single black cell. It should be noted that the dots on the right part of the cell #11 (position of the sixteenth dot of the cell #11 in the moving direction) are shown by dashed lines. This indicates that ink is not ejected at these positions in the present embodiment, taking factors such as bleeding of the ink into account. However, it is also possible to eject ink to these positions. From the foregoing description, it is understood that the width of a single cell in the moving direction is $16/360$ inch.

The dots are formed at a spacing of $1/360$ inch in the paper feed direction as well. As discussed above, the length of the head in the paper feed direction is approximately one inch and the number of nozzles making up the nozzle row is 180 dots, and therefore, the dot spacing of the dots that are formed by a single movement of the ejection head is $1/180$ inch. Therefore, as shown in the right part of FIG. 9, the paper is fed by $1/360$ inch and then dots are formed in a second movement of the ejection head. In this way, the dot spacing becomes $1/360$ inch. That is, the dot resolution becomes 360 dpi, and within a single black cell, eight dots are formed in the paper feed direction. From the foregoing description, it is understood that the width of a single cell in the paper feed direction is $8/360$ inch.

It should be noted that since the blocks are each made of 44 cells in eleven rows and four columns, the width of the block in the moving direction and the paper feed direction is $64/360$ ($=16/360\times4$) inch and $88/360$ ($=8/360\times11$) inch, respectively. Further, since the size of the gap $\alpha$ is defined as $1/32$ of the width of one cell in the moving direction, its size is $1/720$ ($=16/360/32$) inch.

<<<Reading the Darkness of the Correction Pattern, Etc.>>>

Next, FIGS. 12A to 14B are used to describe how the darkness of the correction pattern, which has differences in darkness in the moving direction, is read, and the noise that is generated when reading this darkness. The noise that is generated when reading the darkness is considered by comparing the above-described correction pattern according to the present embodiment (hereinafter, also referred to as the "present pattern") with a conventional example (hereinafter, also referred to as the "conventional pattern").

The printer 22 reads the darkness of the correction pattern while moving the reflective optical sensor 29 in the moving direction, and converts this information into electric signals. That is, the light that is emitted from the light-emitting section 29*a* of the reflective optical sensor 29, or in other words, the incident light, is reflected by the correction pattern, and the reflected light is received by the light-receiving section 29*b* and converted into an electric signal as the output value of the light-receiving sensor that corresponds to the intensity of the reflected light that has been received.

Figure 12A:
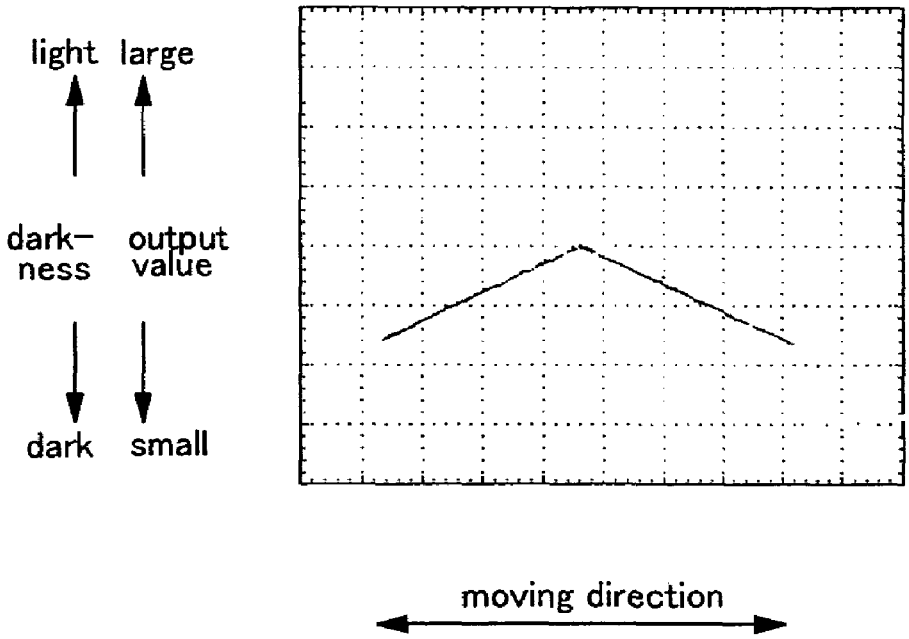
FIG. 12A is a diagram relating to the present pattern, and expresses output values of a light-receiving sensor that are obtained by moving the reflective optical sensor 29 in the moving direction.
Figure 12B:
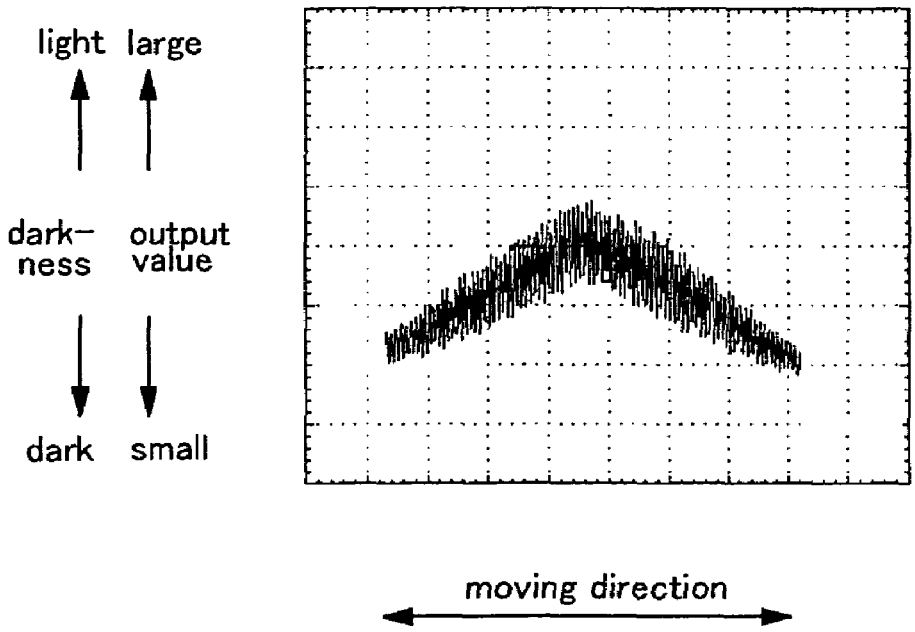
FIG. 12B is a diagram relating to a conventional pattern, and expresses output values of the light-receiving sensor that are obtained by moving the reflective optical sensor 29 in the moving direction.

Now, attention is paid to FIG. 12A and FIG. 12B. FIG. 12A and FIG. 12B are diagrams expressing the output values of the light-receiving sensor that are obtained by moving the reflective optical sensor 29 in the moving direction, in which the horizontal axis represents the position on the correction pattern in the moving direction, and the vertical axis is the output value of the light-receiving sensor. The lighter the darkness of the correction pattern, the higher the output value of the light-receiving sensor, and therefore, the vertical axis can also be said to express the density of the correction pattern. FIG. 12A is for the present pattern, and FIG. 12B is for the conventional pattern.

Figure 13:
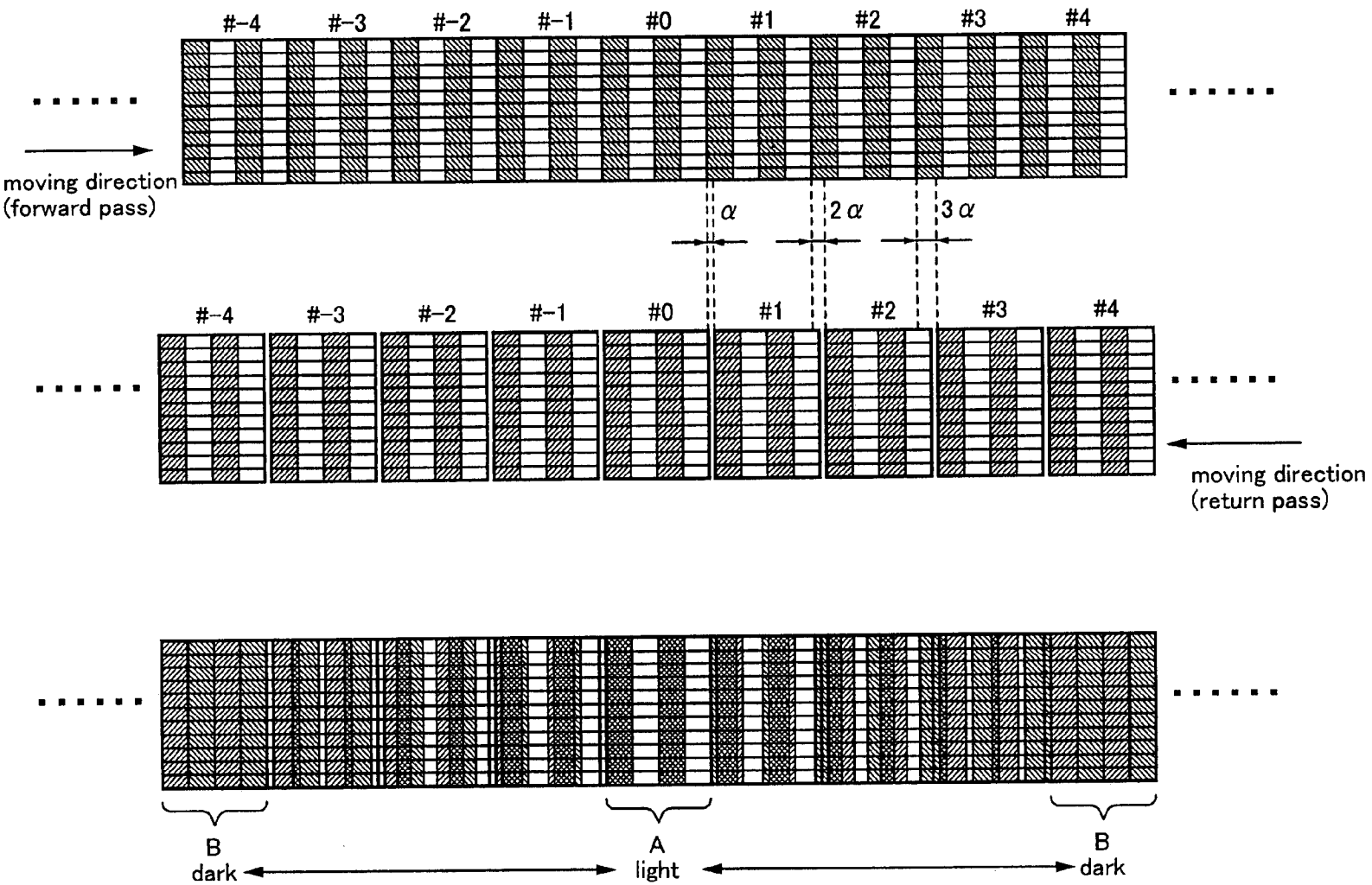
FIG. 13 is a diagram expressing the conventional pattern.

The conventional pattern is described here. As discussed above, the present pattern is a correction pattern that is formed by ejecting ink such that the timing regarding at least two nozzles of the plurality of nozzles in the nozzle row is different for each nozzle. On the other hand, the conventional pattern, as shown in FIG. 13, is a correction pattern that is formed by ejecting ink from the nozzles in the forward and return passes at the same ink ejection timing for the plurality of the nozzles of the nozzle row. FIG. 13 is a diagram corresponding to FIG. 8, and represents the conventional pattern.

Considering FIG. 12A and FIG. 12B, both the present pattern and the conventional pattern exhibit vibration, that is, noise, in the obtained output waveform of the light-receiving sensor, but the output waveform of the light-receiving sensor according to the conventional pattern vibrates more significantly than the output waveform of the light-receiving sensor according to the present pattern. The reason behind why the vibration that is generated in the output waveform of the light-receiving sensor according to the conventional pattern is greater than the vibration that is generated in the output waveform of the light-receiving sensor according to the present pattern is described using FIG. 14A and FIG. 14B. FIG. 14A and FIG. 14B are diagrams showing how the incident light that is emitted from the light-emitting section 29*a* of the reflective optical sensor 29 is incident on the correction patterns. FIG. 14A is for the present pattern, and FIG. 14B is for the conventional pattern.

FIG. 14A and FIG. 14B show the position indicated by the letter A in the figures of the correction patterns shown in the lower section of FIG. 8 and FIG. 13. Further, the circles in FIG. 14A and FIG. 14B represent the spots where the light is incident on the correction pattern, and the manner in which the spot moves from the position X to the position Y is indicated by drawing two circles in FIG. 14A and FIG. 14B.

First, looking at FIG. 14B, simply by the spot slightly moving from the position X to the position Y, there is a significant change in the proportion of regions within the spot in which dots have been formed. That is, at the position X, there is only a very small region within the spot in which dots have been formed, whereas at the position Y, most of the area within the spot is occupied by the region in which dots have been formed. This change in proportion of dot-formed regions is the cause of the vibration that is generated in the output waveform of the light-receiving sensor discussed above.

On the other hand, looking at FIG. 14A, even if the spot moves from the position X to the position Y, there is not much change in the proportion of the region within the spot in which dots have been formed. This is because the present pattern is formed by letting the ink-ejection timings for the plurality of nozzles belonging to a nozzle row be different from one another.

Consequently, using the present pattern, it is possible to inhibit the vibration that is generated in the output waveform of the light-receiving sensor, and thus the accuracy with which the darkness of the correction pattern is read increases, and as a result, discrepancies between the dot formation positions in the moving direction can be accurately corrected.

<<<Method for Correcting Discrepancies between Dot Formation Positions in the Moving Direction Employing the Correction Pattern>>>

Figure 15:
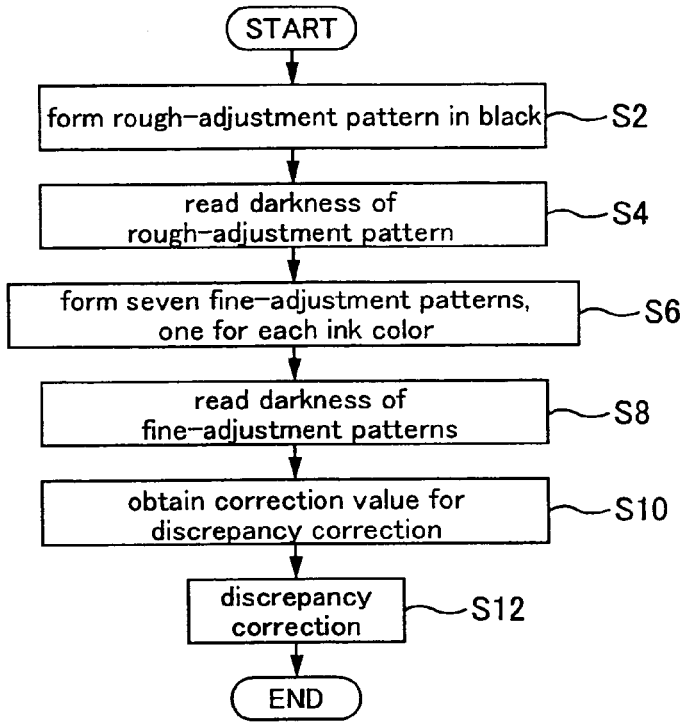
FIG. 15 is a flowchart on the method for correcting discrepancies between dot formation positions in the moving direction.
Figure 16:
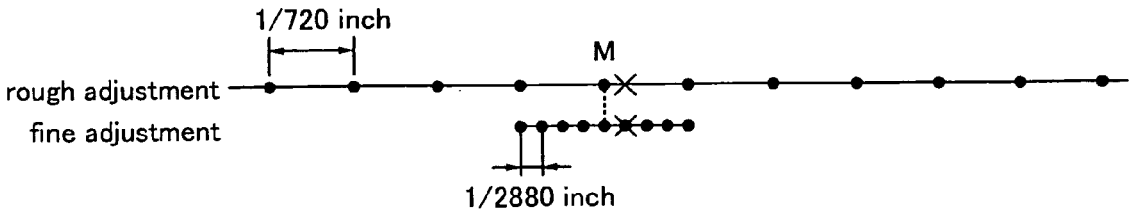
FIG. 16 is a conceptual diagram showing a relationship between rough adjustment using a rough-adjustment pattern and fine adjustment using fine-adjustment patterns.

The method for correcting discrepancies between the dot formation positions in the moving direction using the correction pattern is described next using FIG. 15 and FIG. 16. FIG. 15 is a flowchart for the method of correcting discrepancies between the dot formation positions in the moving direction. FIG. 16 is a conceptual diagram showing a relationship between rough adjustment by a rough-adjustment pattern and fine adjustment by fine-adjustment patterns.

First, the printer 22 ejects ink from the nozzles provided in one of the nozzle rows (in the present embodiment, the black nozzle row is assumed to be the concerned nozzle row) selected from the plurality of nozzle rows to form the above-described present pattern on the print paper P (step S2). That is, first, the correction pattern shown in the lower part of FIG. 8 is formed using black ink.

It should be noted that, although described in greater detail later, in the present embodiment, two correction patterns, namely a correction pattern for performing rough adjustment (hereinafter, also referred to as the "rough-adjustment pattern") and a correction pattern for performing fine adjustment (hereinafter, also referred to as the "fine-adjustment pattern") are formed in order to perform correction of discrepancies. The present pattern is formed as the rough-adjustment pattern.

Next, the printer 22 reads the darkness of the rough-adjustment pattern while moving the reflective optical sensor 29 in the moving direction and converts this information into electric signals (step S4). That is, the light that is emitted from the light-emitting section 29*a* of the reflective optical sensor 29, that is, the incident light, is reflected by the rough-adjustment pattern, and this reflected light is received by the light-receiving section 29*b* and converted into an electric signal serving as the output value of the light-receiving sensor that corresponds to the intensity of the reflected light that has been received.

Next, the printer 22 forms a plurality of the fine-adjustment patterns for each of the plurality of nozzle rows based on the electric signals which serve as the darkness information (step S6). That is, instep S6, seven fine-adjustment patterns are formed, one for each color of ink.

The fine-adjustment patterns is described below. The fine-adjustment patterns are correction patterns that are different from the rough-adjustment pattern, and that are formed while changing, more finely than in the rough-adjustment pattern, the difference between the timing at which ink is ejected from the nozzles in the forward pass and the timing at which ink is ejected from the nozzles in the return pass. That is, the rough-adjustment pattern is formed while changing this difference in units of $1/720$ inch, as mentioned above, whereas the fine-adjustment patterns are formed while changing this difference in units of $1/2880$ inch.

The relationship between rough adjustment using the rough-adjustment pattern and fine adjustment using the fine-adjustment patterns is explained using FIG. 16. As mentioned above, the darkness of the rough-adjustment pattern is read by the reflective optical sensor 29 and converted into an electric signal (step S4), and then, the position where the darkness is the lightest (position A shown in the lower section of FIG. 8) is determined by the control circuit 40 based on this electric signal, which serves as darkness information.

Attention is now paid to the diagram for rough adjustment shown in the upper part of FIG. 16. It is assumed that the position where ink lands in the forward pass is indicated by the X mark, and the positions where ink lands in the return pass are indicated by black circles. The differences between the X mark and each of the black circles correspond to the above-described differences between the timing at which ink is ejected from the nozzles in the forward pass and the timings at which ink is ejected from the nozzles in the return pass. It is considered that, at positions where the darkness of the rough-adjustment pattern is lighter, the timing at which ink is ejected from the nozzles in the forward pass and the timing at which ink is ejected from the nozzles in the return pass match each other at a greater degree. Therefore, by determining the position at which the darkness becomes the lightest as described above, the return-pass timing, which is indicated by the letter M in the figure, is specified. Next, using this return-pass timing as a reference, the fine-adjustment pattern is formed while changing, more finely than in the case of the rough-adjustment pattern, the differences between the timing at which ink is ejected from the nozzles in the forward pass and the timings at which ink is ejected from the nozzles in the return pass. As discussed later, the darkness of the fine-adjustment pattern is also read by the reflective optical sensor 29 and converted into electric signals, and as shown in the diagram for fine adjustment in the lower part of FIG. 16, the change in this difference is finer than that of the rough-adjustment pattern, and thus the timing at which ink is ejected from the nozzles in the forward pass and the timing at which ink is ejected from the nozzles in the return pass can be matched with higher accuracy.

It should be noted that in the present embodiment, the conventional pattern rather than the present pattern is used as the fine-adjustment pattern. Further, the reason why the fine-adjustment patterns are formed for each of the plurality of nozzle rows is because the amount of discrepancy between the dot formation positions in the moving direction in the forward pass and the dot formation positions in the moving direction in the return pass is slightly different among each of the nozzle rows or each of the ink colors.

Next, the printer 22 reads the darkness of the plurality of fine-adjustment patterns while moving the reflective optical sensor 29 in the moving direction and converts these into electric signals (step S8). Then, the sub-pattern with the lightest darkness is determined by the control circuit 40 for each nozzle row based on the electric signals, which serve as the darkness information. As mentioned above, the greater the amount of overlap between the dots that are formed on the print paper P in the forward pass and the dots that are formed on the print paper P in the return pass, the lighter the darkness of the correction pattern becomes, and therefore, the correction value corresponding to the position where the darkness is the lightest is the desired correction value. Consequently, the correction value corresponding to the position where the darkness is the lightest is obtained as the correction value for correcting discrepancies between the moving direction between the dot formation positions (step S10). Then, when printing is subsequently performed, that correction value is input to the drive signal correcting section 230 and the discrepancy is corrected for each of the plurality of nozzle rows (step S12).

===Other Embodiments===

A method for forming a correction pattern etc. according to the present invention has been described above based on an embodiment thereof, but the foregoing embodiment of the invention is for the purpose of elucidating the present invention and is not to be interpreted as limiting the present invention. The present invention can of course be altered and improved without departing from the gist thereof and includes equivalents thereof.

Print paper is described as an example of the medium, but it is also possible to use film, cloth, and thin metal plates, for example, as the medium.

Further, in the foregoing embodiment, the above description was made using an inkjet printer as an example of a liquid ejecting apparatus, but this is not a limitation. For example, the same technology as that of this embodiment can be applied to, for example, color filter manufacturing devices, dyeing devices, fine processing devices, semiconductor manufacturing devices, surface processing devices, three-dimensional shape forming machines, liquid vaporizing devices, organic EL manufacturing devices (particularly macromolecular EL manufacturing devices), display manufacturing devices, film formation devices, and DNA chip manufacturing devices. The effects discussed above can still be achieved even when the present technology is used in these fields, because a feature thereof is that the liquid can be ejected toward a medium.

Further, in the foregoing embodiment, a color inkjet printer was described as an example of the inkjet printer, but this is not a limitation. For example, the present invention can also be adopted for monochrome inkjet printers.

Further, in the foregoing embodiment, ink was described as an example of the liquid, but this is not a limitation. For example, it is also possible to eject, from the nozzles, a liquid (including water) including metallic material, organic material (particularly macromolecular material), magnetic material, conductive material, wiring material, film-formation material, machine liquid, and genetic solutions.

Further, discrepancy correction as discussed above can be carried out according to a request from a user, it can be carried out automatically without a command from the user, or it can be carried out before the user obtains the printer, such as at the time of shipping.

Further, in the foregoing embodiment, a correction pattern that has a difference in darkness in the moving direction and that is for correcting a discrepancy between dot formation positions in the moving direction in a forward pass and dot formation positions in the moving direction in a return pass, is formed on the medium by causing the nozzles to eject the liquid in the forward pass and the return pass while changing a difference between a timing at which the liquid is ejected from the nozzles in the forward pass and a timing at which the liquid is ejected from the nozzles in the return pass. This, however, is not a limitation.

That is, the present invention can be adopted not only for a case where the Bi-D adjustment pattern discussed above is formed as the correction pattern, but also for a case of forming a Uni-D adjustment pattern for correcting discrepancies between the dot formation positions between nozzle rows using a printer having a plurality of nozzle rows, or a case of forming a multi-head adjustment pattern for correcting the discrepancies between the dot formation positions among ejection heads using a printer having a plurality of ejection heads.

Further, in the foregoing embodiment, the nozzle row has a plurality of sub-nozzle rows arranged in the direction of the nozzle row; and the correction pattern is formed by causing the nozzles to eject the ink in such a manner that a timing at which the ink is ejected from the nozzles that belong to even-numbered sub-nozzle rows, among the plurality of sub-nozzle rows, is different from a timing at which the ink is ejected from the nozzles that belong to odd-numbered sub-nozzle rows, the timing at which the ink is ejected from the nozzles that belong to the even-numbered sub-nozzle rows is the same among those sub-nozzle rows, and the timing at which the ink is ejected from the nozzles that belong to the odd-numbered sub-nozzle rows is the same among those sub-nozzle rows. This, however, is not a limitation. As long as at least two of the plurality of nozzles in a nozzle row eject ink at a different timing, for each nozzle, to form the correction pattern, the effect relating to noise as discussed above is achieved. For example, it is also possible to form the correction pattern using any one of the blocks shown in FIG. 17A to FIG. 17C.

The foregoing embodiment, however, is more preferable in terms that it is possible to form a correction pattern with which discrepancies between dot formation positions in the moving direction can be corrected more precisely.

Further, in the foregoing embodiment, the correction pattern is formed by repeating an operation of ejecting the ink from the nozzles that belong to the even-numbered sub-nozzle rows and an operation of ejecting the ink from the nozzles that belong to the odd-numbered sub-nozzle rows. This, however, is not a limitation. For example, it is also possible to form the correction pattern using the block shown in FIG. 17D.

The foregoing embodiment, however, is more preferable in terms that it is possible to form a correction pattern with which discrepancies between dot formation positions in the moving direction can be corrected more precisely.

Further, in the foregoing embodiment, the same number of nozzles belong to each of the plurality of sub-nozzle rows. This, however, is not a limitation. For example, it is also possible to form the correction pattern using the block shown in FIG. 17E.

The foregoing embodiment, however, is more preferable in terms that it is possible to form a correction pattern with which discrepancies between dot formation positions in the moving direction can be corrected more precisely.

Further, in the foregoing embodiment, a single block is made of eleven rows and four columns of cells, but, for example, it can also have eleven rows and two columns of cells as shown in FIG. 17F. The number of rows is of course not limited to eleven.

Further, the darkness of the correction pattern may be read with a reflective optical sensor that is capable of moving in the moving direction and that is for reading the darkness, while moving the reflective optical sensor in the moving direction, and based on darkness information that has been read, the discrepancy may be corrected. That is, in the foregoing embodiment, the darkness of the fine-adjustment patterns is read by the reflective optical sensor, and discrepancies are corrected based on the darkness information of the fine-adjustment patterns that has been read, but it is also possible to correct discrepancies based on the darkness information of the rough-adjustment pattern without forming the fine-adjustment patterns.

In this way, the procedure for forming a correction pattern, with which discrepancies between dot formation positions in the moving direction can be corrected, becomes simple.

Further, in the foregoing embodiment, another correction pattern different from the correction pattern, which has the difference in darkness in the moving direction and which is for correcting the discrepancy between the dot formation positions in the moving direction in the forward pass and the dot formation positions in the moving direction in the return pass, is formed on the print paper by causing the nozzles to eject the ink in the forward pass and the return pass while changing, more finely than in the above-described correction pattern, the difference between the timing at which the ink is ejected from the nozzles in the forward pass and the timing at which the ink is ejected from the nozzles in the return pass. This, however, is not a limitation. That is, in the foregoing embodiment, the rough-adjustment pattern and the fine-adjustment patterns are employed as correction patterns, with the present pattern serving as the rough-adjustment pattern and the conventional pattern serving as the fine-adjustment patterns, but this is not a limitation. For example, it is also possible for the present pattern to be formed as both patterns, or for the conventional pattern to be formed as the rough-adjustment pattern and the present pattern to be formed as the fine-adjustment patterns.

However, the rough-adjustment pattern is formed while changing, more roughly than in the fine-adjustment patterns, the difference between the timing at which the ink is ejected from the nozzles in the forward pass and the timing at which the ink is ejected from the nozzles in the return pass, and thus the above-mentioned vibration occurs more easily. In view of this fact, the foregoing embodiment, in which the rough-adjustment pattern where vibration occurs easily is adopted as the present pattern, has a greater effect.

Further, the correction pattern is formed by ejecting the ink from the nozzles provided in one nozzle row selected from among a plurality of the nozzle rows; the darkness of the correction pattern is read with the reflective optical sensor while moving the reflective optical sensor in the moving direction, and based on darkness information that has been read, a plurality of the other correction patterns are formed, each for one of the plurality of the nozzle rows; and the darkness of the plurality of the other correction patterns is read with the reflective optical sensor while moving the reflective optical sensor in the moving direction, and based on darkness information that has been read, the discrepancy is corrected for each of the plurality of the nozzle rows. This, however, is not a limitation. In the foregoing embodiment, the rough-adjustment pattern is formed using a single color and the fine-adjustment patterns are formed using seven colors so as to perform discrepancy correction, but this is not a limitation. It is also possible to form both patterns using the seven colors and perform discrepancy correction, or to form both patterns using a single color and perform discrepancy correction.

However, because there is very little difference among the ink colors regarding the amount of discrepancy between the dot formation positions in the moving direction in the forward pass and the dot formation positions in the moving direction in the return pass, the foregoing embodiment is more efficient in terms that the rough-adjustment pattern, which is not easily affected by this difference in the amount of discrepancy, is formed using a single color, and the fine-adjustment patterns, which are easily affected by the difference in the amount of discrepancy, are formed using seven colors.

What is claimed is:

1. A correction-pattern forming method for forming a correction pattern on a medium, comprising:

a step of moving a nozzle row in which a plurality of nozzles for ejecting a liquid to form dots on a medium are arranged in a row; and a step of forming a correction pattern that has a difference in darkness in a moving direction of said nozzle row and that is for correcting a discrepancy between dot formation positions in said moving direction by causing at least two nozzles, among the plurality of nozzles, in said nozzle row to eject the liquid at a different timing for each nozzle, wherein said correction pattern has a checkered pattern that includes a plurality of black cells each having a plurality of dots;

wherein a diameter of an incident spotlight of a sensor is larger than a length of said black cell and shorter than twice the length of said black cell in said moving direction; and wherein said diameter of said incident spotlight of said sensor is larger than twice the length of said black cell in a direction perpendicular to said moving direction.

2. A correction-pattern forming method according to claim 1, wherein a correction pattern that has a difference in darkness in said moving direction and that is for correcting a discrepancy between dot formation positions in said moving direction in a forward pass and dot formation positions in said moving direction in a return pass, is formed on said medium by causing said nozzles to eject the liquid in said forward pass and said return pass while changing a difference between a timing at which the liquid is ejected from said nozzles in said forward pass and a timing at which the liquid is ejected from said nozzles in said return pass.

3. A correction-pattern forming method according to claim 2, wherein:

said nozzle row has a plurality of sub-nozzle rows arranged in the direction of said nozzle row; and said correction pattern is formed by causing said nozzles to eject the liquid in such a manner that a timing at which the liquid is ejected from the nozzles that belong to even-numbered sub-nozzle rows, among said plurality of sub-nozzle rows, is different from a timing at which the liquid is ejected from the nozzles that belong to odd-numbered sub-nozzle rows, the timing at which the liquid is ejected from the nozzles that belong to said even-numbered sub-nozzle rows is the same among those sub-nozzle rows, and the timing at which the liquid is ejected from the nozzles that belong to said odd-numbered sub-nozzle rows is the same among those sub-nozzle rows.

4. A correction-pattern forming method according to claim 3, wherein said correction pattern is formed by repeating an operation of ejecting the liquid from the nozzles that belong to said even-numbered sub-nozzle rows and an operation of ejecting the liquid from the nozzles that belong to said odd-numbered sub-nozzle rows.

5. A correction-pattern forming method according to claim 4, wherein a same number of nozzles belong to each of said plurality of sub-nozzle rows.

6. A correction-pattern forming method according to claim 5, wherein the darkness of said correction pattern is read with a sensor that is capable of moving in said moving direction and that is for reading said darkness, while moving said sensor in said moving direction, and based on darkness information that has been read, said discrepancy is corrected.

7. A correction-pattern forming method according to claim 5, wherein another correction pattern different from said correction pattern, which has the difference in darkness in said moving direction and which is for correcting the discrepancy between the dot formation positions in said moving direction in said forward pass and the dot formation positions in said moving direction in said return pass, is formed on said medium by causing said nozzles to eject the liquid in said forward pass and said return pass while changing, more finely than in said correction pattern, the difference between said timing at which the liquid is ejected from said nozzles in said forward pass and said timing at which the liquid is ejected from said nozzles in said return pass.

8. A correction-pattern forming method according to claim 7, wherein:

said correction pattern is formed by ejecting the liquid from said nozzles provided in one said nozzle row selected from among a plurality of the nozzle rows;

the darkness of said correction pattern is read with said sensor while moving said sensor in said moving direction, and based on darkness information that has been read, a plurality of the other correction patterns are formed, each for one of the plurality of said nozzle rows; and the darkness of the plurality of said other correction patterns is read with said sensor while moving said sensor in said moving direction, and based on darkness information that has been read, said discrepancy is corrected for each of the plurality of said nozzle rows.

9. A liquid ejecting apparatus for ejecting a liquid onto a medium, comprising:

nozzles for ejecting a liquid to form dots on a medium;

a nozzle row in which a plurality of said nozzles are arranged in a row; and a controller for moving said nozzle row and causing said nozzles in said nozzle row to eject the liquid;

wherein said controller moves said nozzle row and causes at least two nozzles, among the plurality of said nozzles, in said nozzle row to eject the liquid at a different timing for each nozzle, to form a correction pattern that has a difference in darkness in a moving direction of said nozzle row and that is for correcting a discrepancy between dot formation positions in said moving direction, wherein said correction pattern has a checkered pattern that includes a plurality of black cells each having a plurality of dots, wherein a diameter of an incident spotlight of a sensor is larger than a length of said black cell and shorter than twice the length of said black cell in said moving direction, and wherein said diameter of said incident spotlight of said sensor is larger than twice the length of said black cell in a direction perpendicular to said moving direction.

10. A liquid ejecting apparatus according to claim 9, further comprising:

a sensor that is capable of moving in said moving direction and that is for reading the darkness of said correction pattern.

11. A correction pattern formed on a medium, comprising:

a section formed by a liquid ejected at a predetermined timing from one nozzle among a plurality of nozzles arranged in a row; and a section formed by the liquid ejected at a timing that is different from said predetermined timing from another nozzle among said plurality of nozzles forming the correction pattern that has a difference in darkness in a moving direction of said nozzle row, wherein the correction pattern has a checkered pattern that includes a plurality of black cells each having a plurality of dots, wherein a diameter of an incident spotlight of a sensor is larger than a length of said black cell and shorter than twice the of said black cell in said moving direction, and wherein said diameter of said incident spotlight of said sensor is larger than twice the length of said black cell in a direction perpendicular to said moving direction.

* * * * *